US011970317B2

(12) United States Patent
Peterson et al.

(10) Patent No.: US 11,970,317 B2
(45) Date of Patent: Apr. 30, 2024

(54) PACKAGING FOR PERSONAL CARE PRODUCT

(71) Applicant: Hub Folding Box Company, Inc., Mansfield, MA (US)

(72) Inventors: Zane Peterson, Blackstone, MA (US); David Kamyk, Worcester, MA (US)

(73) Assignee: Hub Folding Box Company, Inc., Mansfield, MA (US)

( * ) Notice: Subject to any disclaimer, the term of this patent is extended or adjusted under 35 U.S.C. 154(b) by 59 days.

(21) Appl. No.: 17/187,118

(22) Filed: Feb. 26, 2021

(65) Prior Publication Data

US 2021/0269191 A1 Sep. 2, 2021

Related U.S. Application Data

(60) Provisional application No. 62/982,913, filed on Feb. 28, 2020.

(51) Int. Cl.

| | |
|---|---|
| ***B65D 5/38*** | (2006.01) |
| ***A45D 40/02*** | (2006.01) |
| ***B65D 5/02*** | (2006.01) |
| ***B65D 5/56*** | (2006.01) |
| ***B65D 6/00*** | (2006.01) |
| ***B65D 6/06*** | (2006.01) |

(52) U.S. Cl.

CPC ..... *B65D 5/38* (2013.01); *A45D 40/02* (2013.01); *B65D 5/0209* (2013.01); *B65D 5/563* (2013.01); *B65D 7/10* (2013.01); *B65D 11/20* (2013.01)

(58) Field of Classification Search

CPC ..... A45D 40/02; B65D 5/38; B65D 5/0209; B65D 5/563; B65D 7/10; B65D 11/20

USPC ..... 206/1.5, 267, 273, 564, 804; 229/101, 229/125.125, 125.26; 215/216

See application file for complete search history.

(56) References Cited

U.S. PATENT DOCUMENTS

| | | | | | |
|---|---|---|---|---|---|
| 3,311,283 | A * | 3/1967 | Katsuji Shimada | B65D 5/6688 | 206/250 |
| 3,480,196 | A * | 11/1969 | De Simas | B65D 19/20 | 229/122 |
| 3,521,810 | A * | 7/1970 | Boyer | B65D 5/38 | 229/148 |
| 3,761,009 | A * | 9/1973 | Rosenburg, Jr. | B65D 5/38 | 229/125.125 |
| 3,949,928 | A * | 4/1976 | Perkins | B65D 5/22 | 229/125.125 |
| 4,053,100 | A * | 10/1977 | Baptist | B65D 5/685 | 229/125.26 |
| 4,109,826 | A * | 8/1978 | Maisonneuve | B65D 5/38 | 426/115 |
| 4,485,922 | A * | 12/1984 | Desmond | B65D 5/5021 | 229/168 |

(Continued)

*Primary Examiner* — Steven A. Reynolds
*Assistant Examiner* — Prince Pal
(74) *Attorney, Agent, or Firm* — Fish & Richardson P.C.

(57) ABSTRACT

A carton includes a tray having at least one locking tab; and a sleeve having an inner wall having indentations, in which the tray and the sleeve are shaped and sized to enable the tray to move within the sleeve. Then at least one locking tab is configured to engage at least one of the indentations to allow the tray to move in a first direction relative to the sleeve and provide a resistance to discourage the tray from moving in a second direction opposite the first direction relative to the sleeve.

42 Claims, 16 Drawing Sheets

(56) References Cited

U.S. PATENT DOCUMENTS 4,497,401 A * 2/1985 Ackerman ..... B65D 5/38 206/121
4,534,463 A * 8/1985 Bouchard ..... B65D 85/1009 229/122
4,557,476 A * 12/1985 Kato ..... A63J 21/00 70/289
4,850,482 A * 7/1989 Campbell ..... B65D 5/5052 206/268
5,050,794 A * 9/1991 Wischusen, III ..... B65D 5/248 229/179
5,082,137 A * 1/1992 Weinstein ..... B65D 43/20 220/345.3
5,180,052 A * 1/1993 Smith ..... B65D 5/5023 229/164
5,454,932 A * 10/1995 Tardif ..... G11B 23/0233 220/348
5,823,352 A * 10/1998 Mena ..... B65D 5/4204 206/721
5,938,031 A * 8/1999 Woods ..... G03D 15/001 206/455
5,941,388 A * 8/1999 Spielberger ..... B65D 25/107 242/598.5
6,168,073 B1 * 1/2001 Towle ..... B65D 5/38 229/122
6,302,322 B1 * 10/2001 Focke ..... B65D 85/1045 206/268
6,402,021 B1 * 6/2002 Heathcock ..... B65D 5/5445 229/242
6,663,100 B2 * 12/2003 Crowley ..... B65H 1/30 271/157
6,745,918 B2 * 6/2004 Greene ..... B65D 83/0005 426/115
6,953,118 B2 * 10/2005 Seno ..... B65D 5/22 206/526
7,464,828 B1 * 12/2008 Unrau ..... A47K 17/00 220/8
8,997,997 B2 * 4/2015 Close ..... A47F 1/125 206/804
9,259,034 B2 * 2/2016 Holford ..... B65D 85/10564
D911,167 S * 2/2021 Tsai ..... D9/432
11,319,108 B2 * 5/2022 Gauvin ..... B65D 5/38
11,505,358 B2 * 11/2022 Wang ..... B65D 5/32
2004/0168951 A1 * 9/2004 Mackie, Jr. ..... B65D 5/5028 206/534
2007/0039840 A1 * 2/2007 Mu ..... B65D 5/4295 206/278
2008/0142397 A1 * 6/2008 Heller ..... B65D 33/02 206/499
2009/0152134 A1 * 6/2009 Katsis ..... B65D 5/38 206/96
2009/0302097 A1 * 12/2009 Vincent ..... B65D 5/0254 229/120.33
2011/0000955 A1 * 1/2011 Manteufel ..... B65D 5/728 229/103
2011/0132779 A1 * 6/2011 Loughman ..... B65D 5/4204 229/125.125
2011/0266335 A1 * 11/2011 Glowacki ..... B65D 5/62 493/162
2015/0041352 A1 * 2/2015 Huang ..... B65D 21/086 206/454
2015/0197386 A1 * 7/2015 Chang ..... B65D 5/64 206/514
2016/0251107 A1 * 9/2016 Everett ..... B65D 5/38 206/1.5
2016/0362215 A1 * 12/2016 Patel ..... B32B 27/34
2020/0115095 A1 * 4/2020 Whitehurst ..... B65D 5/0254
2020/0223602 A1 * 7/2020 Foltz ..... B65D 5/38
2020/0299022 A1 * 9/2020 Young ..... B65D 5/5445
2021/0047072 A1 * 2/2021 Ng Pak Leung .... B65D 5/4608
2021/0237927 A1 * 8/2021 Fiore, Jr. ..... B65D 5/38
2021/0354872 A1 * 11/2021 Ling ..... B65D 5/5038
2022/0119171 A1 * 4/2022 Levitz ..... B65D 50/045
2022/0315273 A1 * 10/2022 Dayioglu ..... B65D 5/38
2022/0332460 A1 * 10/2022 Bressan ..... B65D 5/38
2022/0371769 A1 * 11/2022 Polier ..... B65D 77/2024
2023/0015201 A1 * 1/2023 Arango ..... B65D 5/4266

* cited by examiner

PACKAGING FOR PERSONAL CARE PRODUCT

CROSS-REFERENCE TO RELATED APPLICATION

This application claims priority to U.S. Provisional Patent Application Ser. No. 62/982,913, filed on Feb. 28, 2020, the entire contents of which are hereby incorporated by reference.

TECHNICAL FIELD

This disclosure relates to packaging for personal care products.

BACKGROUND

Some personal care products, such as deodorant sticks or bars, are often placed in plastic containers that may be difficult to recycle. Each year a large number of these plastic containers end up in landfills and may be harmful to the environment.

SUMMARY

In a general aspect, a carton includes a tray and a sleeve. The tray has at least one locking tab, and the sleeve has an inner wall having indentations, in which the tray and the sleeve are shaped and sized to enable the tray to move within the sleeve. The at least one locking tab is configured to engage at least one of the indentations to allow the tray to move in a first direction relative to the sleeve and provide a resistance to discourage the tray from moving in a second direction opposite the first direction relative to the sleeve.

Implementations can include one or more of the following features. At least one of the tray or the sleeve can include a folded paperboard, a folded plastic sheet, or a folded metal sheet. At least one of the tray or the sleeve can include at least one of plastic, bio-resin, paper pulp, or metal molded components. At least one of the tray or the sleeve can include a folded paperboard, and the carton can include a lining on the paperboard to form a moisture or oil barrier. The lining can include at least one of polyresin or bioresin. The tray can have a bottom having a first shape, the sleeve can have a cross section having a second shape, and the first and second shapes can be similar shapes. The sleeve can have a cross section having a shape that resembles at least one of a triangle, a square, a rectangle, a rhombus, a pentagon, a polygon, a circle, or an oval. The tray can be configured to hold a bar that has at least one indentation on a sidewall of the bar, and the tray can include at least one bar locking tab configured to engage at least one of the at least one indentation on the sidewall of the bar. The at least one locking tab can be folded outwards and downwards relative to other parts of the tray, and the at least one bar locking tab can be folded inwards and downwards relative to other parts of the tray. The at least one locking tab can include a first locking tab and a second locking tab that are positioned on opposite sides of the tray, and the at least one bar locking tab can include a first bar locking tab and a second bar locking tab that are positioned on opposite sides of the tray.

In another general aspect, a carton for a deodorant bar is provided. The carton includes: a tray, a sleeve, and a locking mechanism. The tray is configured to hold the deodorant bar. The tray and the sleeve are shaped and sized to enable the tray to move within the sleeve. The locking mechanism is configured to secure the tray at one of a plurality of predetermined positions relative to the sleeve, in which the locking mechanism enables the tray to move in a first direction relative to the sleeve and prevents the tray from moving in a second direction opposite the first direction.

Implementations can include one or more of the following features. At least one of the tray or sleeve can include a folded board. At least one of the tray or sleeve can include a folded paperboard or cardboard. The carton can include a lining on the paperboard to form a moisture or oil barrier. The lining can include at least one of polyresin or bioresin. The tray can have a bottom having a first shape, the sleeve can have a cross section having a second shape, and the first and second shapes can be similar shapes. The sleeve can have a cross section having a shape that resembles at least one of a triangle, a square, a rectangle, a rhombus, a pentagon, a polygon, a circle, or an oval. The locking mechanism can include indents on inner sidewalls of the sleeve and at least one locking tab on the tray, and the at least one locking tab can be configured to engage one of the indents to secure the tray at the one of the plurality of predetermined positions relative to the sleeve. The tray can be configured to hold a bar that has at least one indentation on a sidewall of the bar, and the tray can include at least one bar locking tab configured to engage at least one of the at least one indentation on the sidewall of the bar. The at least one locking tab can be folded outwards and downwards relative to other parts of the tray, and the at least one bar locking tab can be folded inwards and downwards relative to other parts of the tray. The at least one locking tab can include a first locking tab and a second locking tab that are positioned on opposite sides of the tray, and the at least one bar locking tab can include a first bar locking tab and a second bar locking tab that are positioned on opposite sides of the tray.

In another general aspect, an apparatus includes: a board having a shape configured to enable the board to be folded into a tray having a tuck flap having a tab, in which the tuck flap forms a bottom wall of the tray and an inner sidewall of the tray, and the tab is folded over an edge of an outer sidewall of the tray.

Implementations can include one or more of the following features. The tuck flap can be configured such that when a downward force pushes against the bottom wall of the tray, the tab latches on to the edge of the outer sidewall of the tray and secures the bottom wall in place. The board can include a paperboard, a cardboard, a plastic board, or a metal board. After folding the board, a first portion of the board can be securely attached to a second portion of the board.

In another general aspect, an apparatus includes: a first board having a first shape configured to enable the first board to be folded into a sleeve having a series of indents on an inner sidewall; and a second board having a second shape configured to enable the second board to be folded into a tray having a locking tab that is configured to engage one of the indents of the sleeve when the tray is positioned in the sleeve.

Implementations can include one or more of the following features. The board can include a paperboard, a cardboard, a plastic board, or a metal board. The shape of the board can be configured to enable the tray to have a tuck flap having a tab, in which the tuck flap can form a bottom wall of the tray and an inner sidewall of the tray, and the tab can be folded over an edge of an outer sidewall of the tray.

In another general aspect, an apparatus includes a carton configured to contain a deodorant bar. The carton includes: a tray configured to hold the deodorant bar, the tray having at least one locking tab; and a sleeve having an inner wall having indentations, in which the tray and the sleeve are shaped and sized to enable the tray to move within the sleeve. The at least one locking tab is configured to engage at least one of the indentations to allow the tray to move in a first direction relative to the sleeve and provide a resistance to discourage the tray from moving in a second direction opposite the first direction relative to the sleeve.

Implementations can include one or more of the following features. The apparatus can further include the deodorant bar. At least one of the tray or the sleeve can include a folded paperboard or cardboard. The carton can include a lining on the paperboard to form a moisture or oil barrier. The lining can include at least one of polyresin or bioresin. The tray can have a bottom having a first shape, the sleeve can have a cross section having a second shape, and the first and second shapes can be similar shapes. The sleeve can have a cross section having a shape that resembles at least one of a triangle, a square, a rectangle, a rhombus, a pentagon, a polygon, a circle, or an oval. The deodorant bar can have at least one indentation on a sidewall of the deodorant bar, and the tray can include at least one bar locking tab configured to engage at least one of the at least one indentation on the sidewall of the deodorant bar. The at least one locking tab can be folded outwards and downwards relative to other parts of the tray, and the at least one bar locking tab can be folded inwards and downwards relative to other parts of the tray. The at least one locking tab can include a first locking tab and a second locking tab that are positioned on opposite sides of the tray, and the at least one bar locking tab can include a first bar locking tab and a second bar locking tab that are positioned on opposite sides of the tray.

In another general aspect, an apparatus includes a carton configured to contain a deodorant bar. The carton includes: a tray configured to hold the deodorant bar; a sleeve, in which the tray and the sleeve are shaped and sized to enable the tray to move within the sleeve; and a locking mechanism to secure the tray at one of a plurality of predetermined positions relative to the sleeve. The locking mechanism enables the tray to move in a first direction relative to the sleeve and provides a resistance to discourage the tray from moving in a second direction opposite the first direction.

Implementations can include one or more of the following features. At least one of the tray or sleeve can include a folded board. At least one of the tray or sleeve can include a folded paperboard or cardboard. The carton can include a lining on the paperboard to form a moisture or oil barrier. The lining can include at least one of polyresin or bioresin. The tray can have a bottom having a first shape, the sleeve can have a cross section having a second shape, and the first and second shapes can be similar shapes. The sleeve can have a cross section having a shape that resembles at least one of a triangle, a square, a rectangle, a rhombus, a pentagon, a polygon, a circle, or an oval. The locking mechanism can include indents on inner sidewalls of the sleeve and at least one locking tab on the tray, and the at least one locking tab can be configured to engage one of the indents to secure the tray at the one of the plurality of predetermined positions relative to the sleeve. The deodorant bar can have at least one indentation on a sidewall of the deodorant bar, and the tray can include at least one bar locking tab configured to engage at least one of the at least one indentation on the sidewall of the deodorant bar. The at least one locking tab can be folded outwards and downwards relative to other parts of the tray, and the at least one bar locking tab can be folded inwards and downwards relative to other parts of the tray. The at least one locking tab can include a first locking tab and a second locking tab that are positioned on opposite sides of the tray, and the at least one bar locking tab can include a first bar locking tab and a second bar locking tab that are positioned on opposite sides of the tray.

In another general aspect, a method includes: holding a bar in a tray having at least one locking tab; positioning the tray in a sleeve, in which the sleeve has a plurality of indentations on an inner side wall; and engaging the at least one locking tab with at least one of the plurality of indentations to maintain the tray and the bar at a specific height relative to the sleeve.

In another general aspect, a method includes: providing a board having a first portion, a second portion, and a third portion, in which the third portion forms a tuck flap. The method includes folding the first portion of the board to form sidewalls of a tray; and folding the second portion of the board to form a first bottom wall of the tray, in which a slot is formed between an edge of the first bottom wall and a lower edge of a sidewall. The method includes folding the tuck flap and passing a first portion and a second portion of the tuck flap through the slot, using a third portion of the tuck flap that did not pass through the slot to form a bottom wall, and using the second portion of the tuck flap to form an inner sidewall. The method further includes folding the first portion of the tuck flap over an upper edge of one of the sidewalls of the tray formed from the first portion of the board.

In another general aspect, a method includes: providing a tray having a first sidewall, a second sidewall, and a tuck flap, in which the tuck flap forms a bottom wall, an inner side wall, and a tab. The bottom wall has a first edge that is connected to a lower edge of the first sidewall, the bottom wall has a second edge that is connected to a lower edge of the inner sidewall, the inner sidewall has an upper edge that is connected to the tab, and the tab is folded over an upper edge of the second sidewall. The method includes applying a downward force to the bottom wall; and distributing a least a portion of the downward force to the first and second sidewalls of the tray.

In another general aspect, an apparatus includes a carton configured to hold a product. The carton includes: a tray configured to hold the product; a sleeve, in which the tray and the sleeve are shaped and sized to enable the tray to move within the sleeve; and a locking mechanism configured to secure the tray at one of a plurality of predetermined positions relative to the sleeve. The locking mechanism is configured such that when the tray is at one of the predetermined positions, the locking mechanism provides a resistance to prevent the tray from moving away from the predetermined position, and the locking mechanism enables the tray to be moved from a current position to a new position relative to the sleeve when a force is applied to the tray to overcome the resistance provided by the locking mechanism.

Implementations can include one or more of the following features. The locking mechanism can enable the tray to move in a first direction relative to the sleeve and prevent the tray from moving in a second direction opposite the first direction. The sleeve can include a plurality of indents formed on an inner sidewall of the sleeve, and the tray can include at least one locking tab configured to engage at least one of the indents on the sleeve. The locking mechanism can enable the tray to move in an upward direction relative to the sleeve in some time periods and in a downward direction relative to the sleeve in other time periods when the force is applied to the tray to overcome the resistance provided by the locking mechanism. The sleeve and the tray can include embossed tabs or bumps that are configured to hold the tray at the predetermined positions relative to the sleeve. At least one of the tray or sleeve can include a folded board. At least one of the tray or sleeve can include a folded paperboard or cardboard. A lining or a printed barrier coating can be provided on the paperboard to form a moisture or oil barrier. The lining can include at least one of polyresin or bioresin. The tray can have a bottom having a first shape, the sleeve can have a cross section having a second shape, and the first and second shapes can be similar shapes. The sleeve can have a cross section having a shape that resembles at least one of a triangle, a square, a rectangle, a rhombus, a pentagon, a polygon, a circle, or an oval. The product can have at least one indentation on a sidewall of the product, and the tray can include at least one product locking tab configured to engage at least one of the at least one indentation on the sidewall of the product. The at least one product locking tab can be folded inwards and downwards relative to other parts of the tray. The at least one product locking tab can include a first product locking tab and a second product locking tab that are positioned on opposite sides of the tray. The apparatus can further include the product. The product can include at least one of a deodorant bar, a healing balm, a lip balm, a fragrance bar, a wax bar, or an air freshener.

The details of one or more embodiments of the subject matter described in this specification are set forth in the accompanying drawings and the description below. Other features, aspects, and advantages of the invention will become apparent from the description, the drawings, and the claims.

DETAILED DESCRIPTION

This description relates in general to packaging for a personal care product such as a deodorant bar. In some implementations, a recyclable carton for a bar-shaped product includes a tray, a sleeve, and a lid. The tray supports the bar and is slidable within the sleeve. The inner wall(s) of the sleeve include notches or indents positioned at various heights along the wall(s), and the tray includes one or more side tabs that engage one or more of the notches or indents to support the tray at various positions relative to the sleeve. This way, when a user uses the bar and the bar becomes shorter over time, the user can push the tray upwards to expose additional portions of the bar, and the tray can maintain its position due to the side tab(s) engaging the notch(es) or indent(s). The lid covers the exposed portion of the bar to keep, e.g., moisture and/or fragrance of the bar within the carton.

Figure 1:
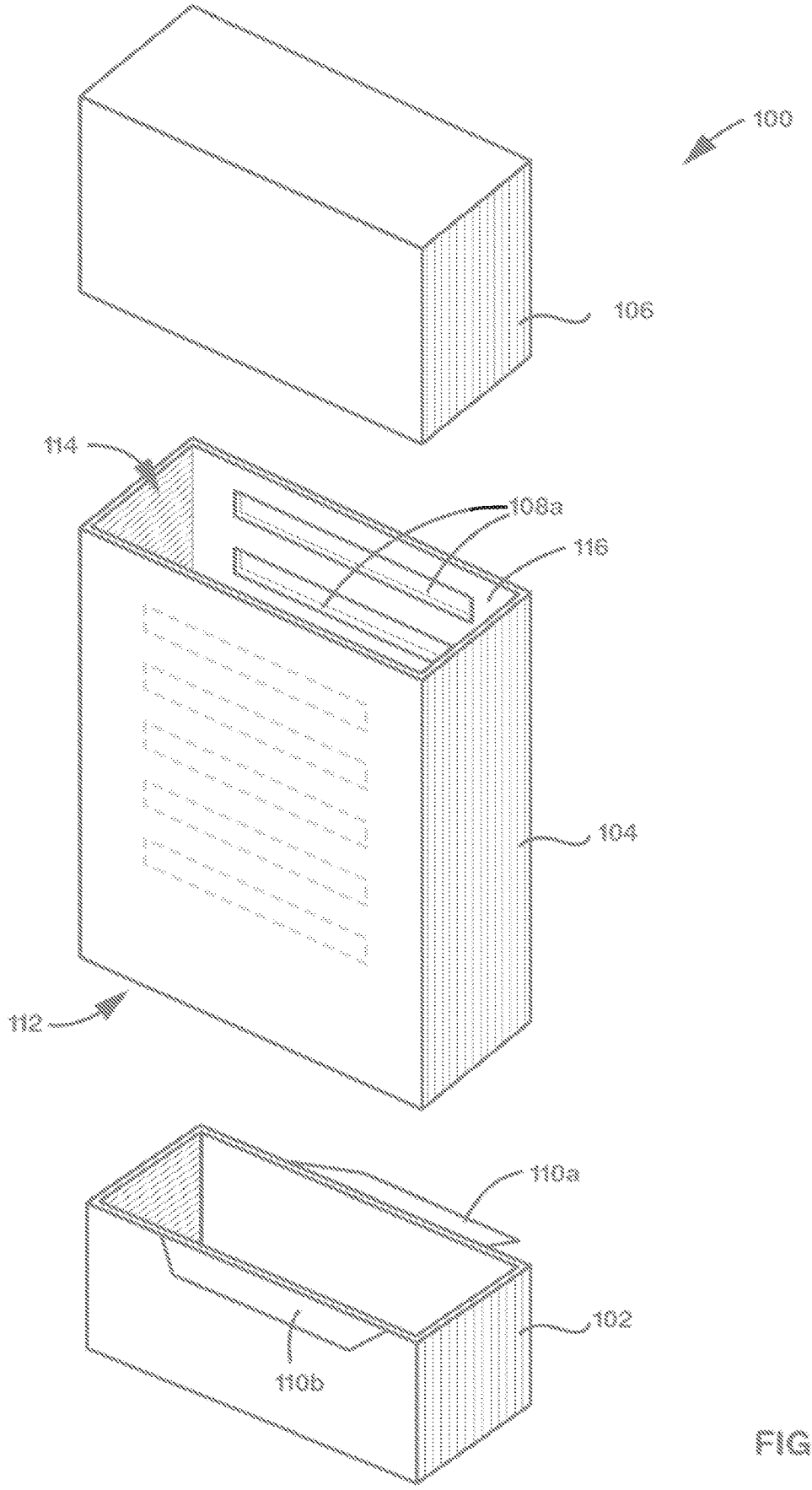
FIG. 1 is an exploded perspective view of an example of an adjustable carton for a bar-shaped product.
Figure 2:
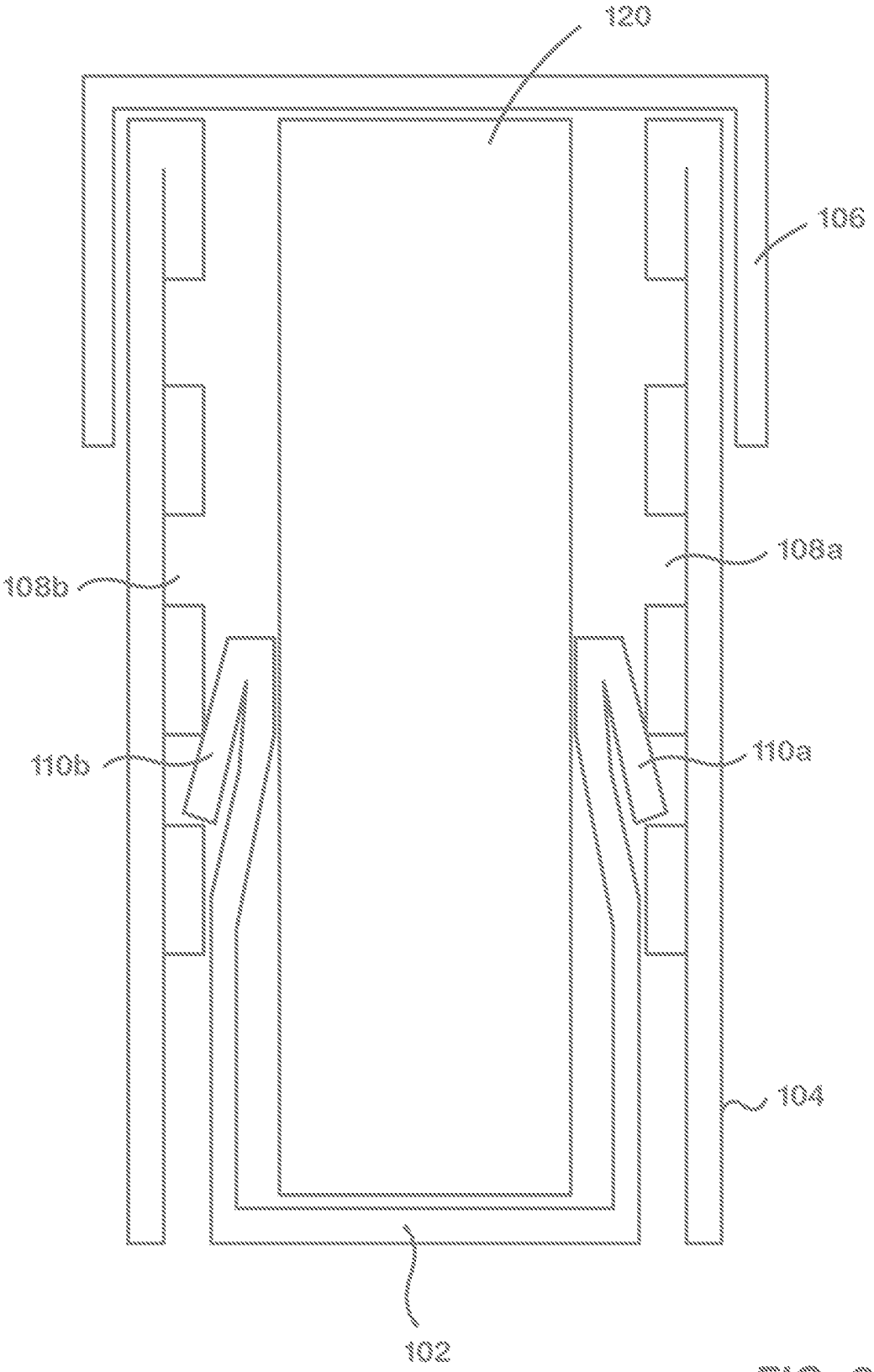
FIG. 2 is a cross-sectional diagram of the carton holding a bar.

FIG. 1 is an exploded perspective view of an example of an adjustable carton for a bar-shaped product. FIG. 2 shows a cross-sectional diagram of the carton 100 holding the bar-shaped product. Referring to FIGS. 1 and 2, in some implementations, a carton 100 includes a tray 102, a sleeve 104, and a lid 106. The tray 102 is configured to hold a bar-shaped product 120, such as a deodorant bar. The sleeve 104 has a lower opening 112 that allows the tray 102 and the bar 120 to slide into the sleeve 104. The sleeve 104 has an upper opening 114 that allows the bar 120 to protrude from the sleeve 104. The outer circumference of the side walls of the tray 102 is slightly smaller than the inner circumference of the side walls of the sleeve 104 so that the tray 102 can fit within the sleeve 104. The inner circumference of the side walls of the lid 106 is slightly larger than the outer circumference of the side walls of the sleeve 104 so that the lid 106 can slide over the upper part of the sleeve 104. The lid 106 covers the exposed portion of the bar 120 to keep, e.g., moisture and/or fragrance of the bar within the carton 100.

In some implementations, the inner wall or walls 116 of the sleeve 104 include notches or indents 108 positioned at various heights along the inner walls 116. In this example, the indents 108 are formed using cutouts in inner sidewalls of the sleeve 104. The tray 102 includes one or more locking tabs, e.g., 110*a* and 110*b* (collectively referenced as 110), that allow the tray 102 to be pushed in one direction within the sleeve 104. In this example, the locking tabs 110 are folded downward and allow the tray 102 to be pushed upwards, but not downwards, within the sleeve 104. The locking tabs 110 engage the indents 108 so that the tray 102 can maintain its position at a particular height relative to the sleeve 104.

In some examples, the indents 108 form a "staircase" within the sleeve 104 that allows the tray 102 to climb up the staircase one "stair" or indent at a time. Locking the tray 102 at a particular height relative to the sleeve 104 allows the bar 120 to be held at a convenient and usable height.

The distance between any two consecutive indents 108 defines the step size in which the tray 102 can be maintained at particular heights relative to the sleeve 104. For example, if the indents 108 are spaced evenly apart from each other at a distance of a quarter of an inch, each time the user pushes the tray 102 upwards a step, an additional quarter of an inch of the bar 120 extends beyond the upper edge of the sleeve 104.

In this description, the terms "upwards" and "downwards" refer to the directions shown in the drawings. It is understood that the carton 100 can be used in various orientations such that the upper part of the carton 100 can face downwards (or sideways) relative to Earth and the lower part of the carton 100 can face upwards (or sideways) relative to Earth.

In some implementations, the carton 100 is made of a recyclable material, such as paperboard. The paperboard can be wax treated or coated for wet-strength. For example, the carton 100 can have lining made of polyresin or bioresin. Polyresins which can be extruded onto the paperboard include, e.g., polyester, polypropylene, or polyethylene. Examples of bioresin include biodegradable composites such as Terratek BD, biodegradable plastic such as bio-based polybutylene succinate (BioPBS™), or NatureStar. Alternatively, these resins can be first extruded into rolls and then laminated to the paperboard substrate. In some examples, printed barrier coatings are applied during the decoration of the materials. Printed barrier coatings include, e.g., UV coatings, aqueous coatings, anti-fungal coatings, and MVTR (moisture vapor transfer) coatings. Application methods include, e.g., Mire-rod, Gravure, Flexo, Offset, Pad-Print, and/or Cast. The lining and/or coating serves several functions, including e.g., forming a moisture or oil barrier, keeping moisture and/or fragrance of the bar 120 in the carton 100, limiting transfer of oil from the bar 120 to the exterior of the carton 100, and increasing the life span of the carton 100 in humid or wet environments, such as in bathrooms.

In some implementations, the tray 102 can be made of, e.g., paper pulp, thermoform plastic, or injection molded plastic.

In FIG. 1, the lid 106 is shown to cover a portion of the upper part of the sleeve 102. In some examples, the lid 106 can have a depth that is the same as the height of the sleeve 104 so that the lid 106 covers the entire sleeve 104 (see the example in FIG. 16). For example, the exterior of the lid 106 can be printed with beautiful packaging artwork, product information, and company logo, and the sleeve 104 can have a plain design. The lid 106 slides over the exterior of the sleeve 104 and does not affect the functioning of the tray 102 inside the sleeve 104. The locking tabs 110 of the tray 102 can engage the indents 108 on the inner walls of the sleeve 104 without being affected by the lid 106.

In some examples, after the carton 100 is assembled and filled with a new bar 120, the entire carton package is shrink wrapped to insure "freshness" and long shelf life for the bar 120.

In the example of FIG. 1, the tray 102 includes locking tabs 110*a* and 110*b* on two sides of the tray 102. In some examples, the tray 102 can include a single locking tab, and the indents 108 are located on one inner wall of the sleeve 104.

In some examples, the locking tab 110*a* is connected to the adjacent sidewall of the tray 102 and is formed by folding the locking tab 110*a* along a line between the locking tab 110*a* and the adjacent sidewall. The locking tab 110*b* is part of a tuck flap on the tray 102, in which the tuck flap forms an inner wall of the tray 102. The locking tab 110*b* is folded along a line between the locking tab 110*b* and the inner wall, in which the locking tab 110*b* folds over the outer wall of the tray 102 and holds the tuck flap in place. This design allows the bar 120 to be held securely in the tray 102 during use. The tuck flap is a continuous piece that connects to a bottom edge of a sidewall, and forms the bottom wall and an inner sidewall of the tray 102. Latching the locking tab 110*b* onto the outer wall of the tray 102 prevents the tuck flap from bending or falling apart when the bar 120 pushes against the bottom wall during use.

In some examples, the locking tab 110*b* is similar to the locking tab 110*a* in which the locking tab 110*b* is connected to the adjacent sidewall of the tray 102 and is formed by folding the locking tab 110*b* along a line between the locking tab 110*b* and the adjacent sidewall.

In some examples, the tray 102 is a seal-end tray that can hold the bar 120 securely. The seal-end tray is assembled from a shaped cardboard by gluing tabs connected to walls to adjacent walls. The seal-end tray has simple locking tabs similar to the locking tab 110*a*. The seal-end tray requires less material as compared to the example in which the tuck flap is used. The seal-end tray may require machinery to erect and glue efficiently.

Figure 3:
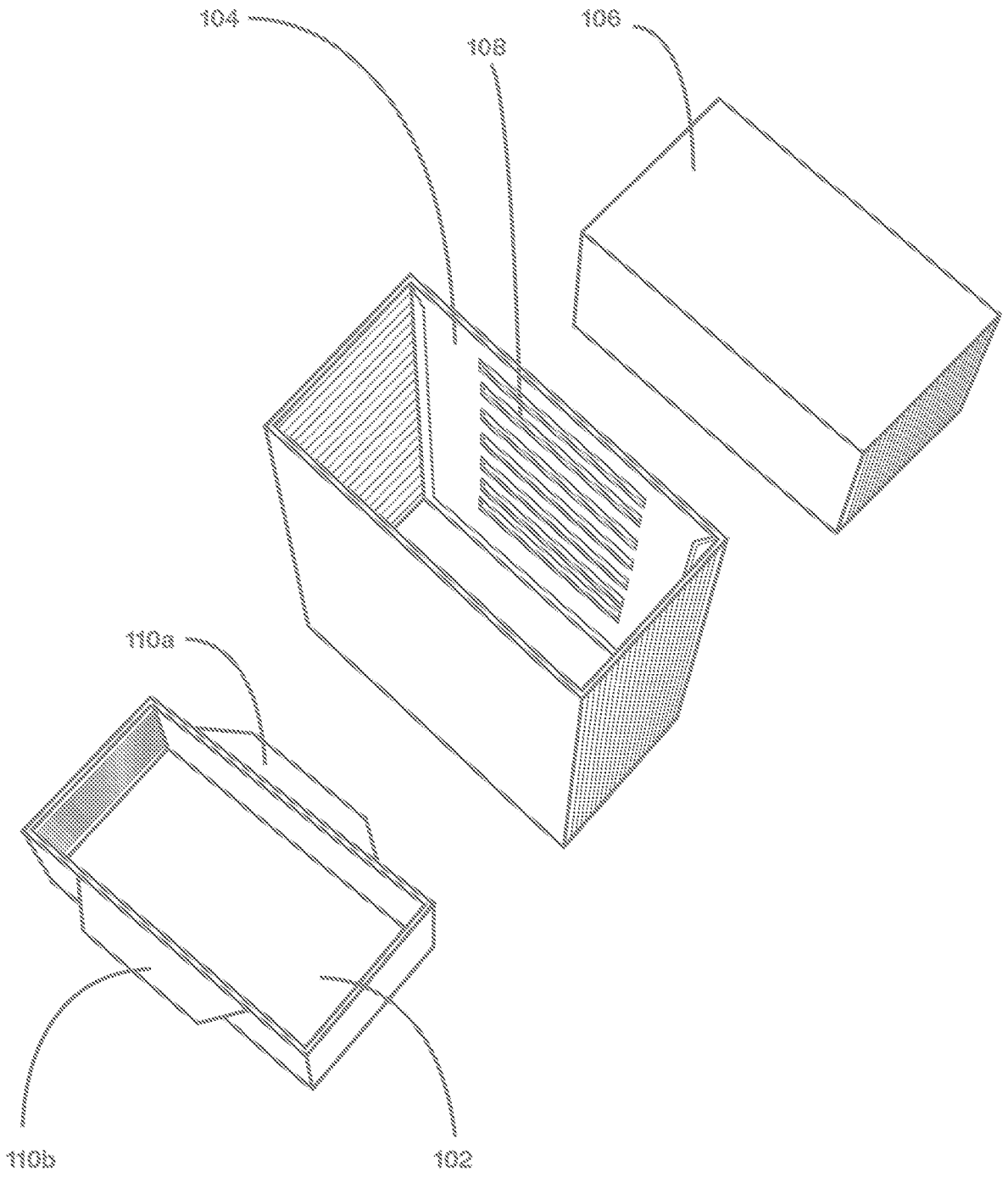
FIG. 3 is an image of an example of a tray, a sleeve, and a lid.

FIG. 3 is an image of an example of a tray 102, a sleeve 104, and a lid 106.

Figure 4:
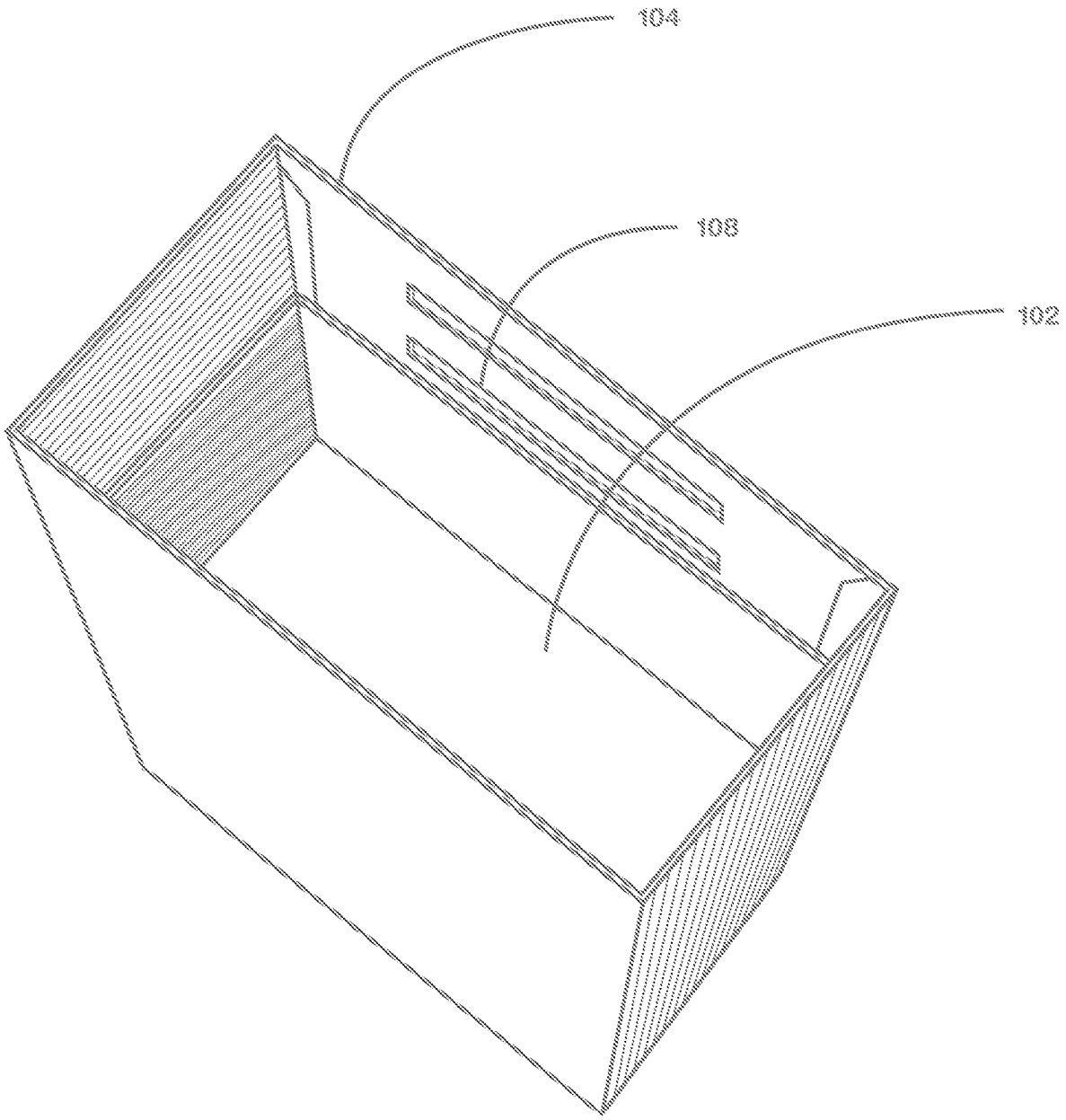
FIG. 4 is an image of an example of the tray positioned inside the sleeve.

FIG. 4 is an image of an example of the tray 102 positioned inside the sleeve 104.

Figure 5:
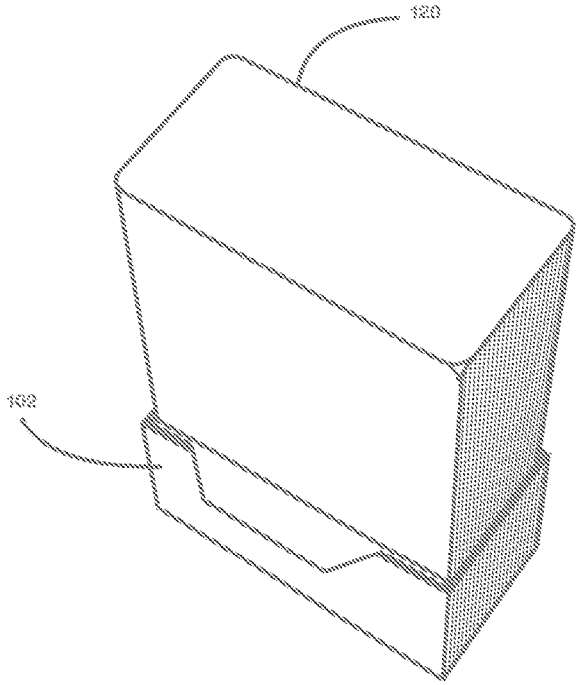
FIG. 5 is an image of an example of the tray holding a bar.

FIG. 5 is an image of an example of the tray 102 holding a bar 120.

Figure 6:
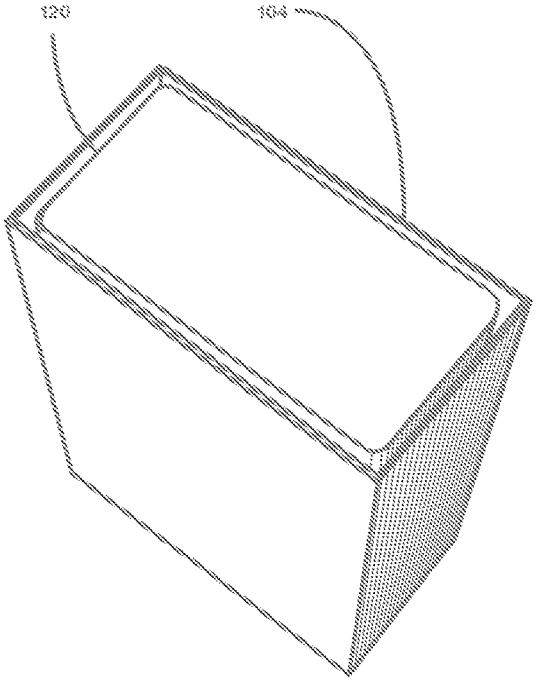
FIG. 6 is an image of an example of the tray and the bar positioned in the sleeve.

FIG. 6 is an image of an example of the tray 102 and the bar 120 positioned within the sleeve 104.

Figure 7:
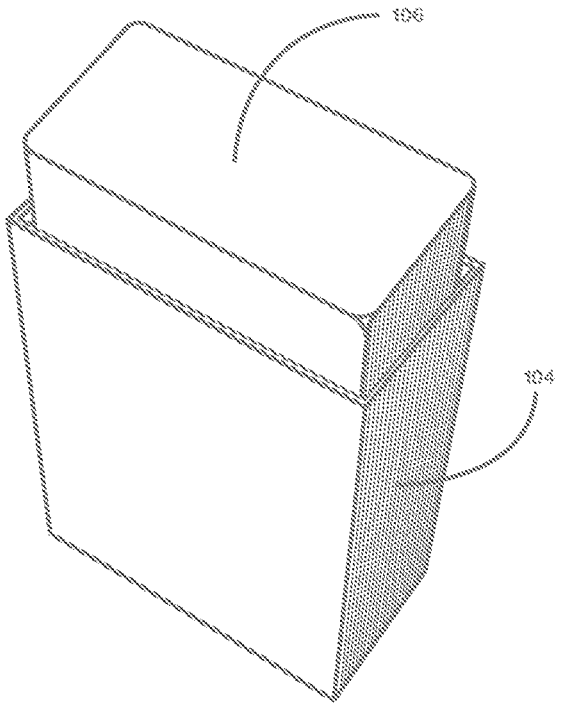
FIGS. 7 and 8 are images of examples of the tray positioned at two different heights in the sleeve.

FIG. 7 is an image of an example of the tray 102 positioned at a first height within the sleeve 104, which causes a portion of the bar 120 to protrude from the sleeve 104.

Figure 8:
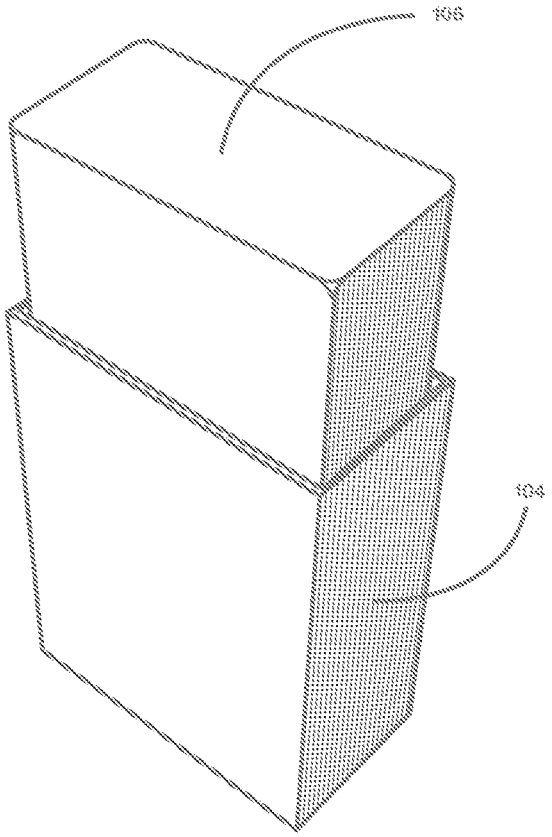

FIG. 8 is an image of an example of the tray 102 positioned at a second height within the sleeve 104, which causes a larger portion of the bar 120 to protrude from the sleeve 104 (as compared to the example in FIG. 7).

Figure 9:
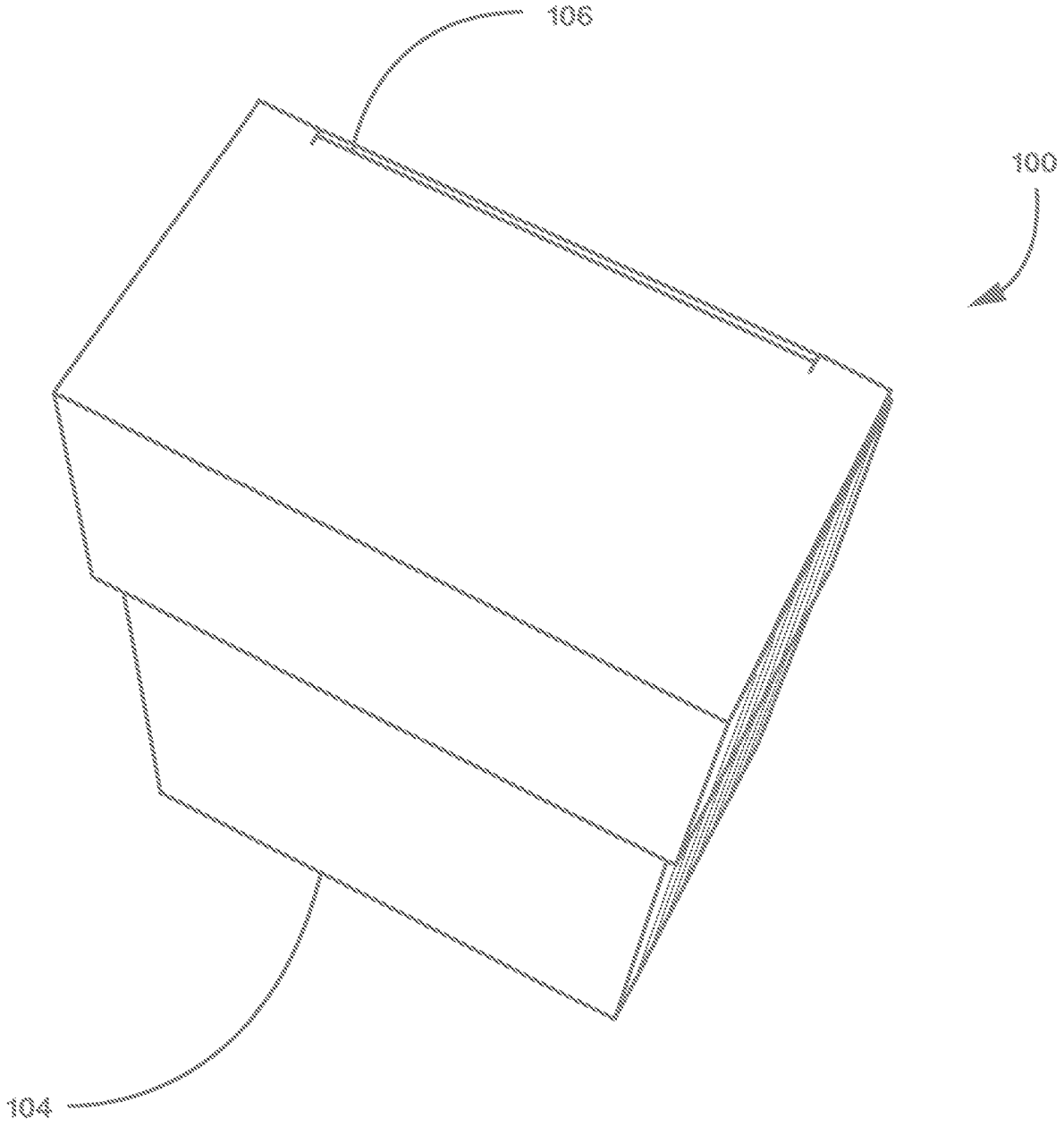
FIG. 9 is an image of an example of the carton.

FIG. 9 is an image of an example of the carton 100 in which the lid 106 covers the top portion of the sleeve 104.

Figure 10:
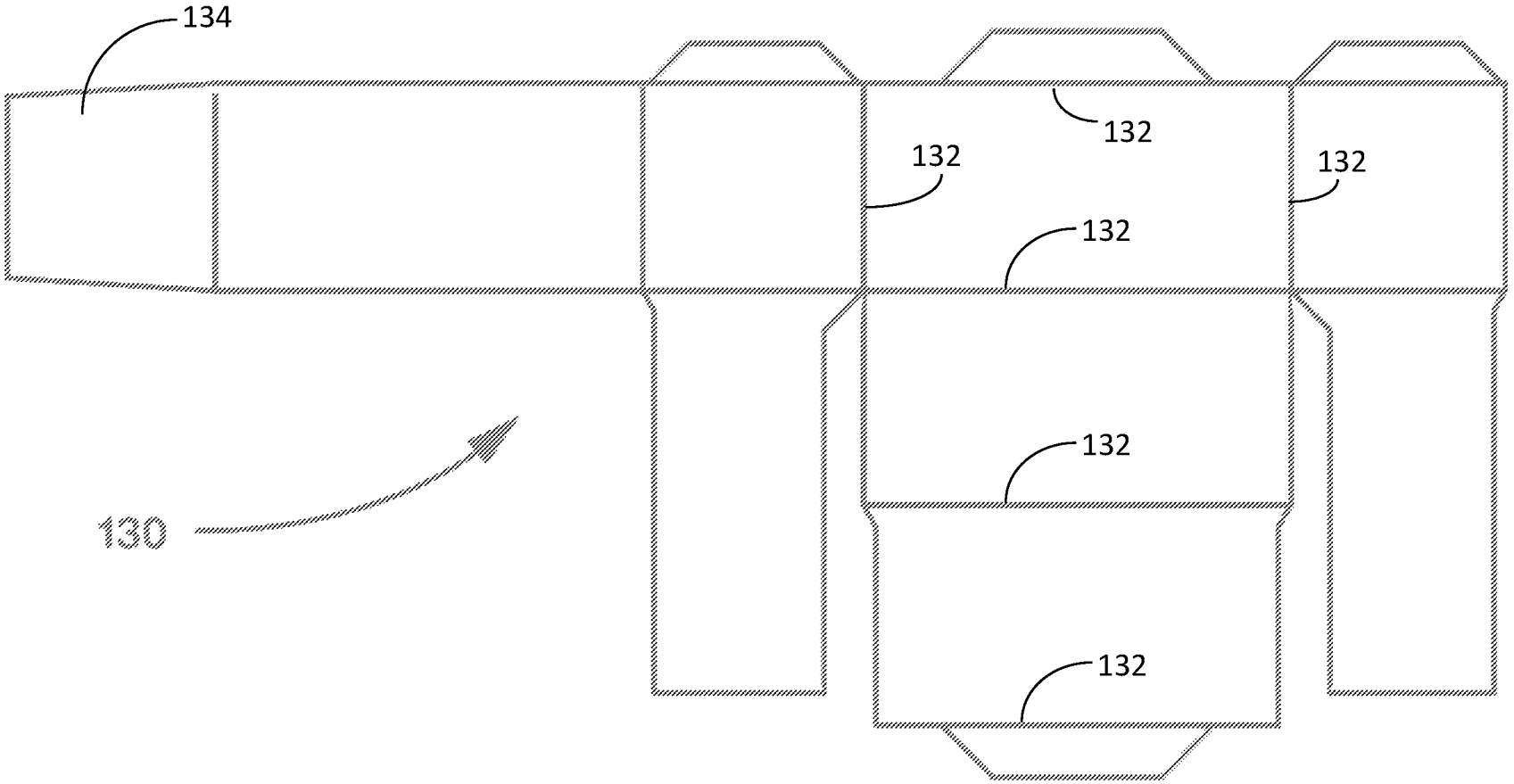
FIG. 10 is a diagram of an example of a paperboard layout for the tray.

FIG. 10 is a diagram of an example of a paperboard layout 130 for the tray 102. The diagram shows the fold lines (e.g., 132) where the paperboard is folded, and a region 134 where glue is applied to fasten the parts of the paperboard together.

Figure 11:
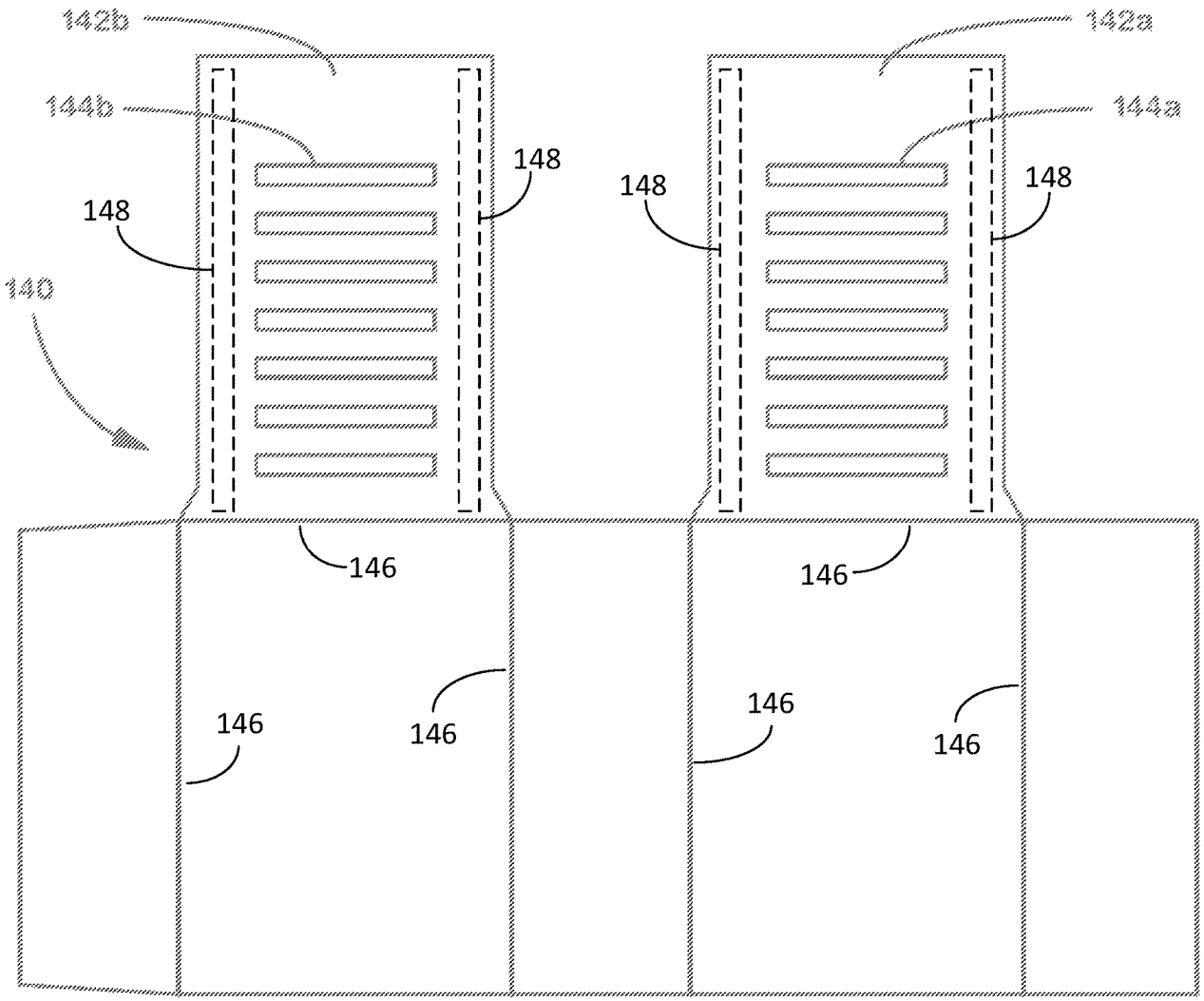
FIG. 11 is a diagram of an example of a paperboard layout for the sleeve.

FIG. 11 is a diagram of an example of a paperboard layout 140 for the sleeve 104. The diagram shows the fold lines (e.g., 146) where the paperboard is folded, and regions (e.g., 148) where glue is applied to fasten the parts of the paperboard together. The paperboard includes a first portion 142*a* having cutouts 144*a* that form the indents 108*a*, and a second portion 142*b* having cutouts 144*b* that form the indents 108*b*.

Figure 12:
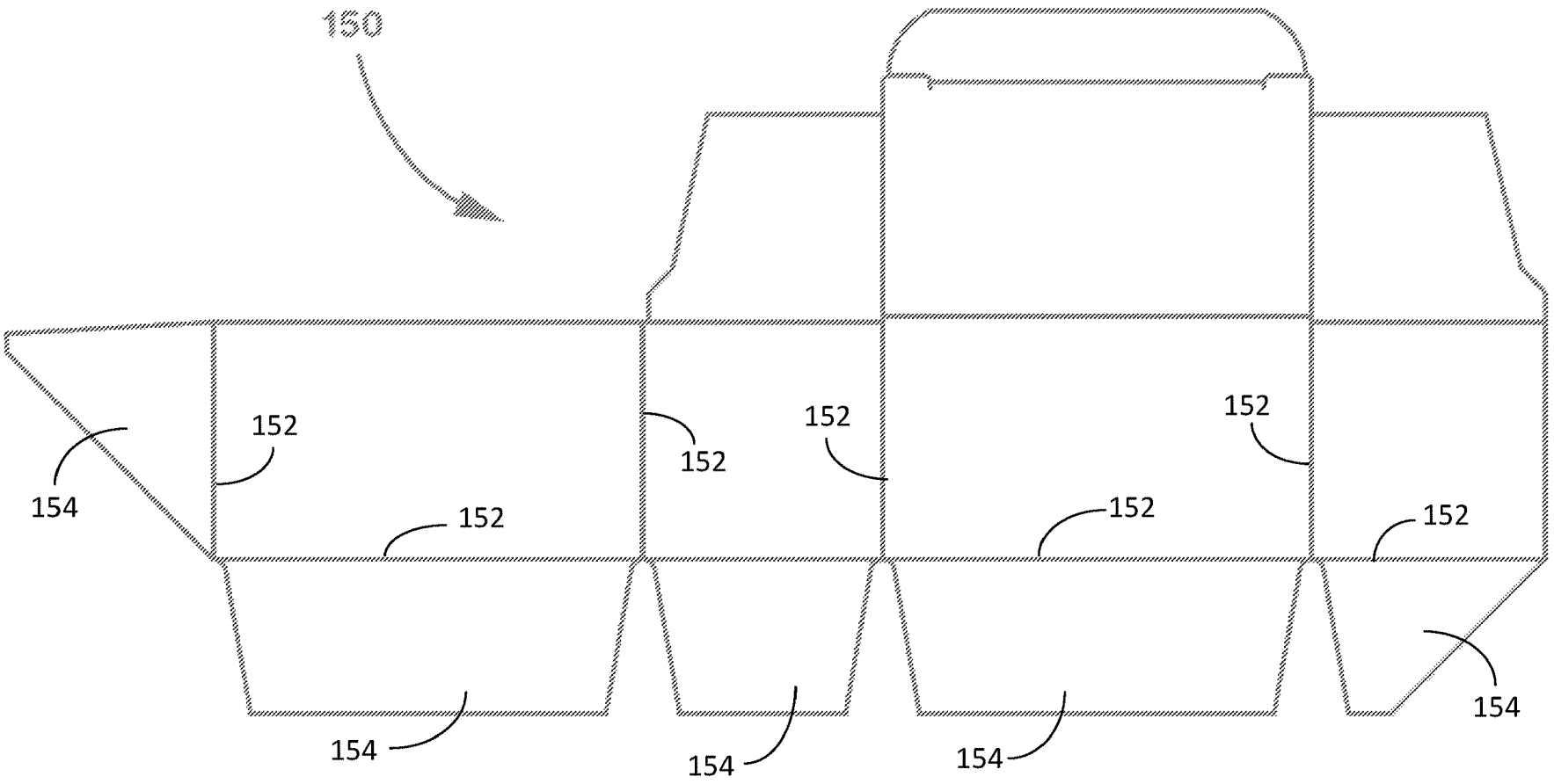
FIG. 12 is a diagram of an example of a paperboard layout for the lid.

FIG. 12 is a diagram of an example of a paperboard layout 150 for the lid 106. The diagram shows the fold lines (e.g., 152) where the paperboard is folded, and regions (e.g., 154) where glue is applied to fasten the parts of the paperboard together.

Figure 13:
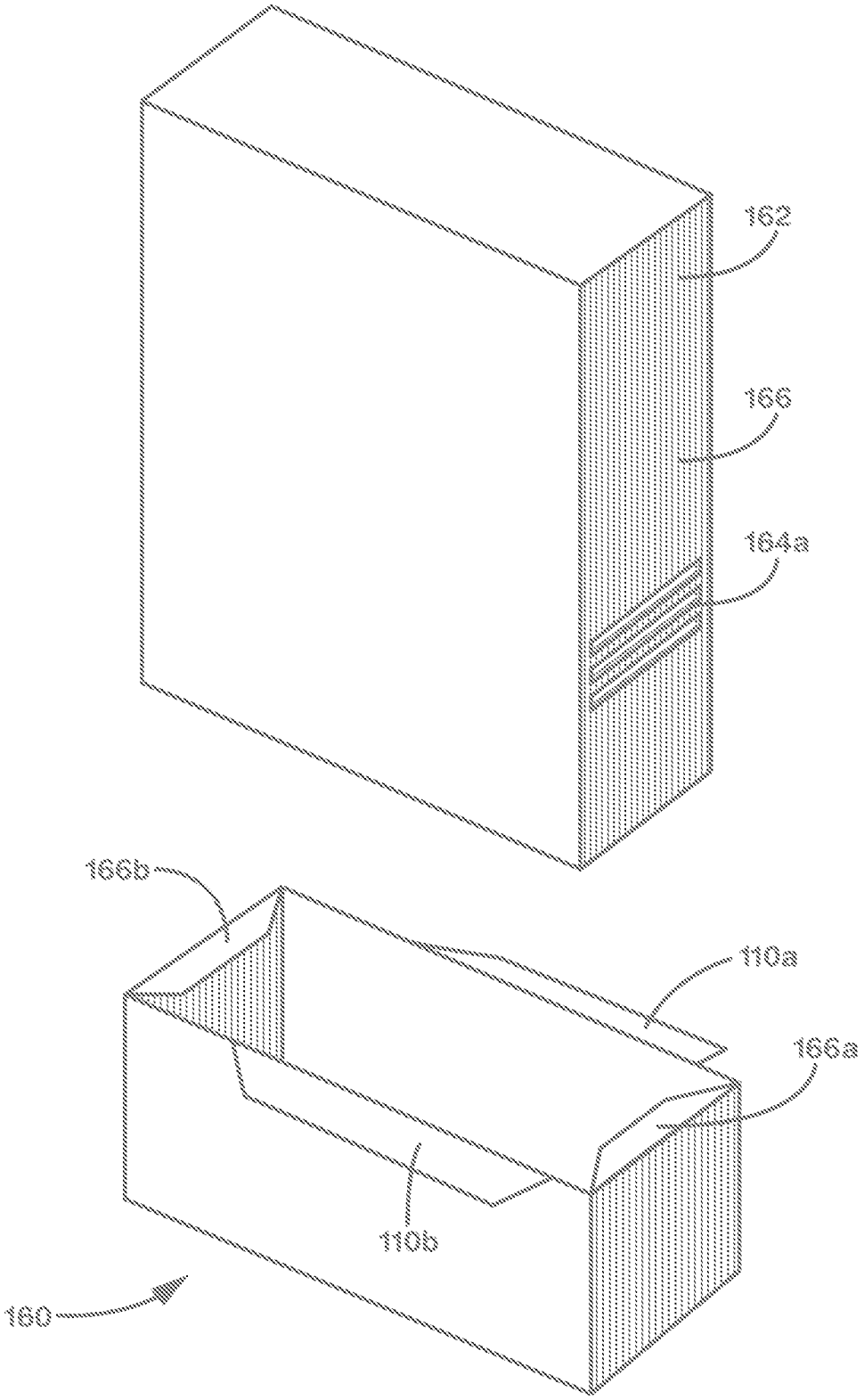
FIG. 13 is a diagram of an example of a tray and a bar.

Referring to FIG. 13, in some implementations, a tray 160 and a bar 162 include a locking mechanism to enable the tray 160 to securely hold the bar 162 regardless of the orientation of the tray 160 and the bar 162. For example, the bar 162 includes one or more notches or indents 164*a* formed at a first side 166 of the bar 162, and one or more notches or indents 164*b* (not shown in the figure) formed at a second side 168 (opposite to the first side 166, not shown in the figure) of the bar 162. The tray 160 includes tabs 166*a* and 166*b* that are folded inward and downward. When the bar 162 is pushed into the tray 160, the tab 166*a* latches onto one of the indents 164*a*, and the tab 166*b* latches onto one of the indents 164*b*. The tabs 166*a* and 166*b* and the indents 164*a* and 164*b* prevent the bar 162 from sliding out of the tray 160 when the tray 160 is held upside down.

In some examples, one indent 164*a* and one indent 164*b* are provided at the sides of the bar 162. Once the tabs 166*a* and 166*b* latch onto the indents 164*a* and 164*b*, respectively, there is no need to further move the bar 162 relative to the tray 160. In some examples, due to tolerances in manufacturing the indents and the tabs, two or more indents are provided on each side 166, 168 of the bar 162 to ensure that the tabs 166*a* and 166*b* latch onto at least one of the indents on each side 166, 168 of the bar 162.

In the example of FIG. 13, the tray 160 includes two tabs 166*a* and 166*b* that latch onto two indents 164*a* and 164*b*, respectively. In some examples, the tray has a single tab, and the bar has a single indent, in which the tab latches onto the indent to prevent the bar from sliding out of the tray.

In some examples, the tray includes two or more tabs on each side that latch onto corresponding two or more indents on the corresponding side of the bar to enable the tray to more securely hold the bar.

Figure 14A:
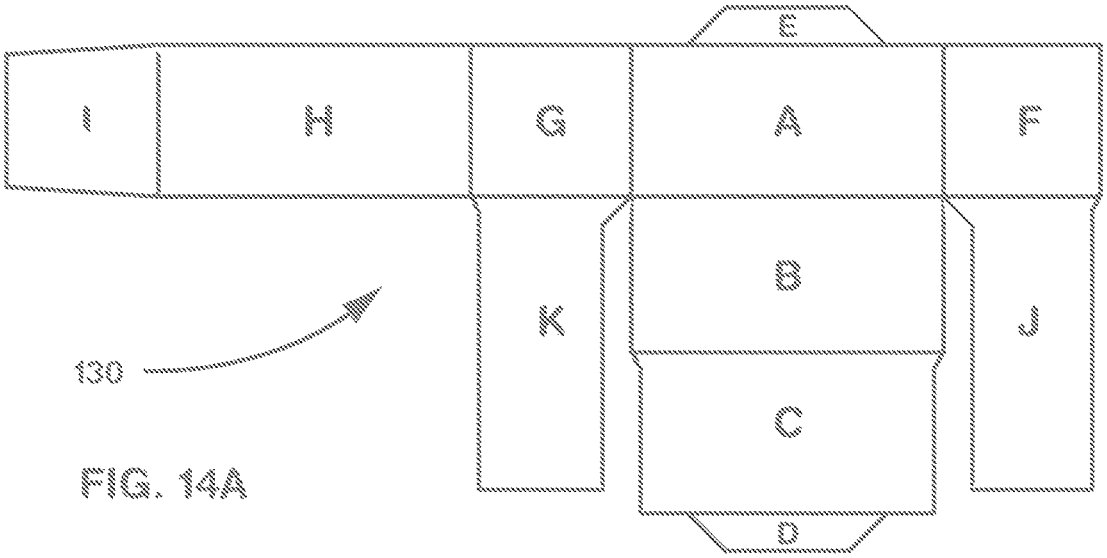
FIG. 14A is a diagram of an example of a paperboard layout for the tray.

FIG. 14A shows the layout 130 of the paperboard for the tray 102, in which different parts of the paperboard have been labeled from "A" to "I." The portions F, A, and H form the outer side layers of the tray 102, the portions J, K, and B form the bottom layers of the tray 102, and the portion C forms an inner side layer that is adjacent to the outer side layer H. The portion I is glued to the portion F. The portions D and E form the locking tabs.

Figure 14B:
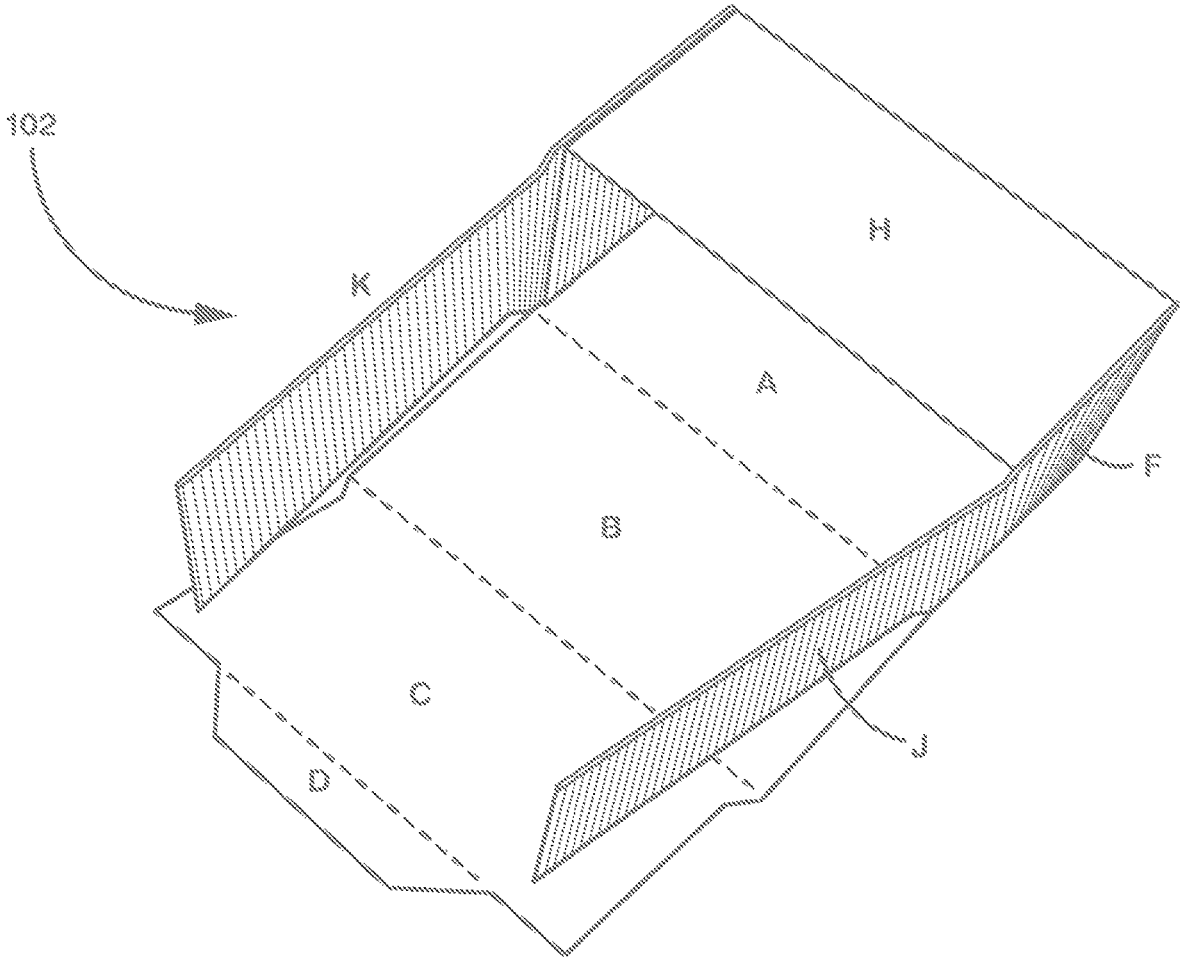
FIGS. 14B to 14E are images showing an example of a process for forming the tray from the paperboard.

FIG. 14B shows an example of a partially assembled tray 102. The portions F, A, H, and I have been folded and glued to form the four sides of the tray 102.

Figure 14C:
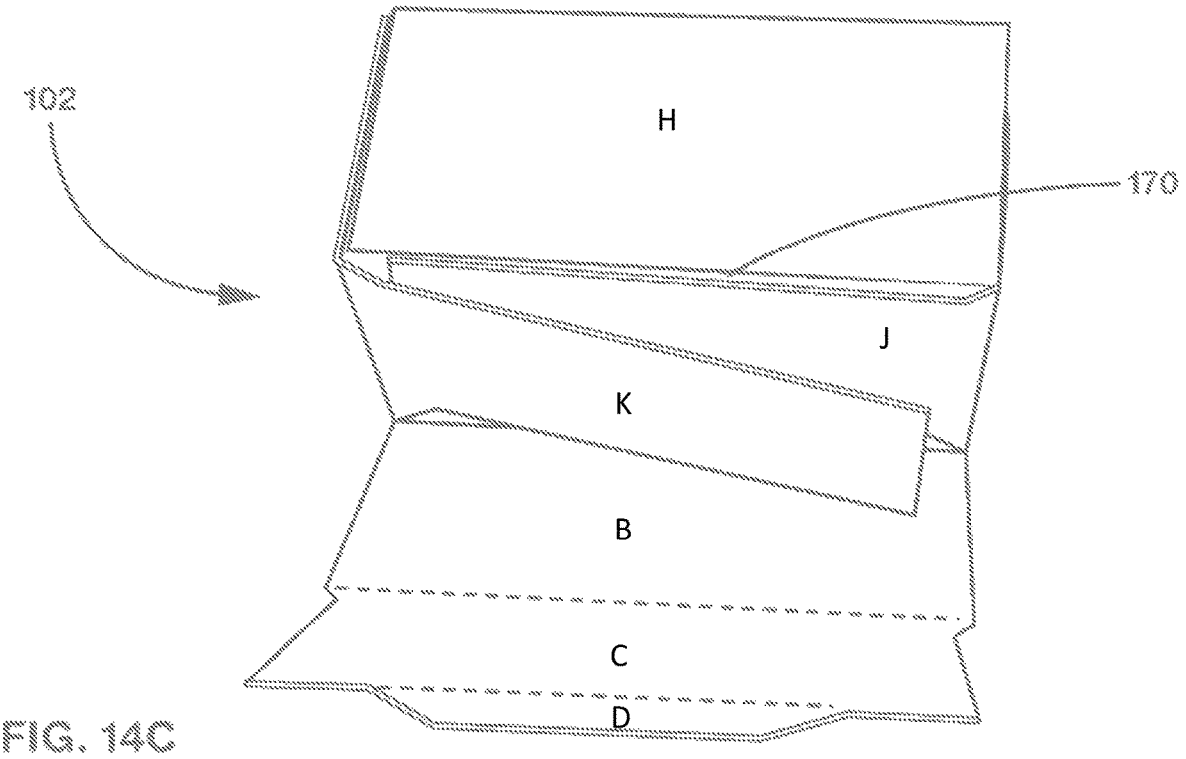

FIG. 14C shows an example in which the portions J and K are folded inward to form the bottom layers. The width of the portions J and K is slightly smaller than the width of the sides F and G so that a slot 170 is formed between the portions J, K and the portion H.

Figure 14D:
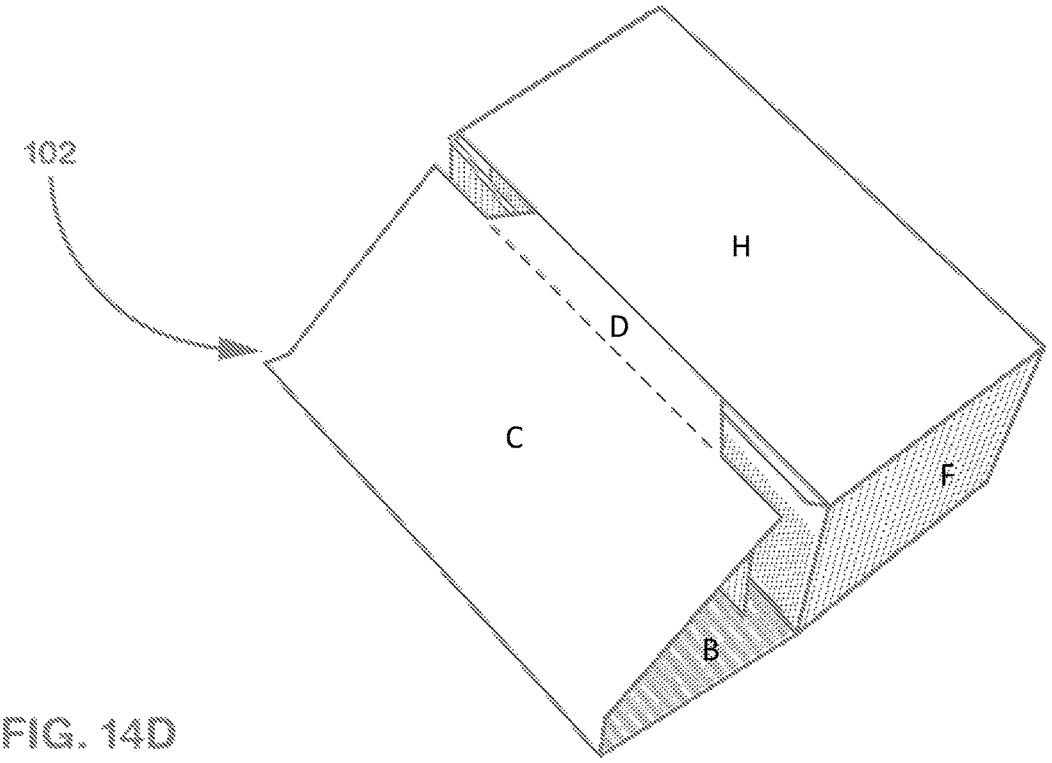

FIG. 14D shows an example in which the portion D is partially tucked through the slot 170.

Figure 14E:
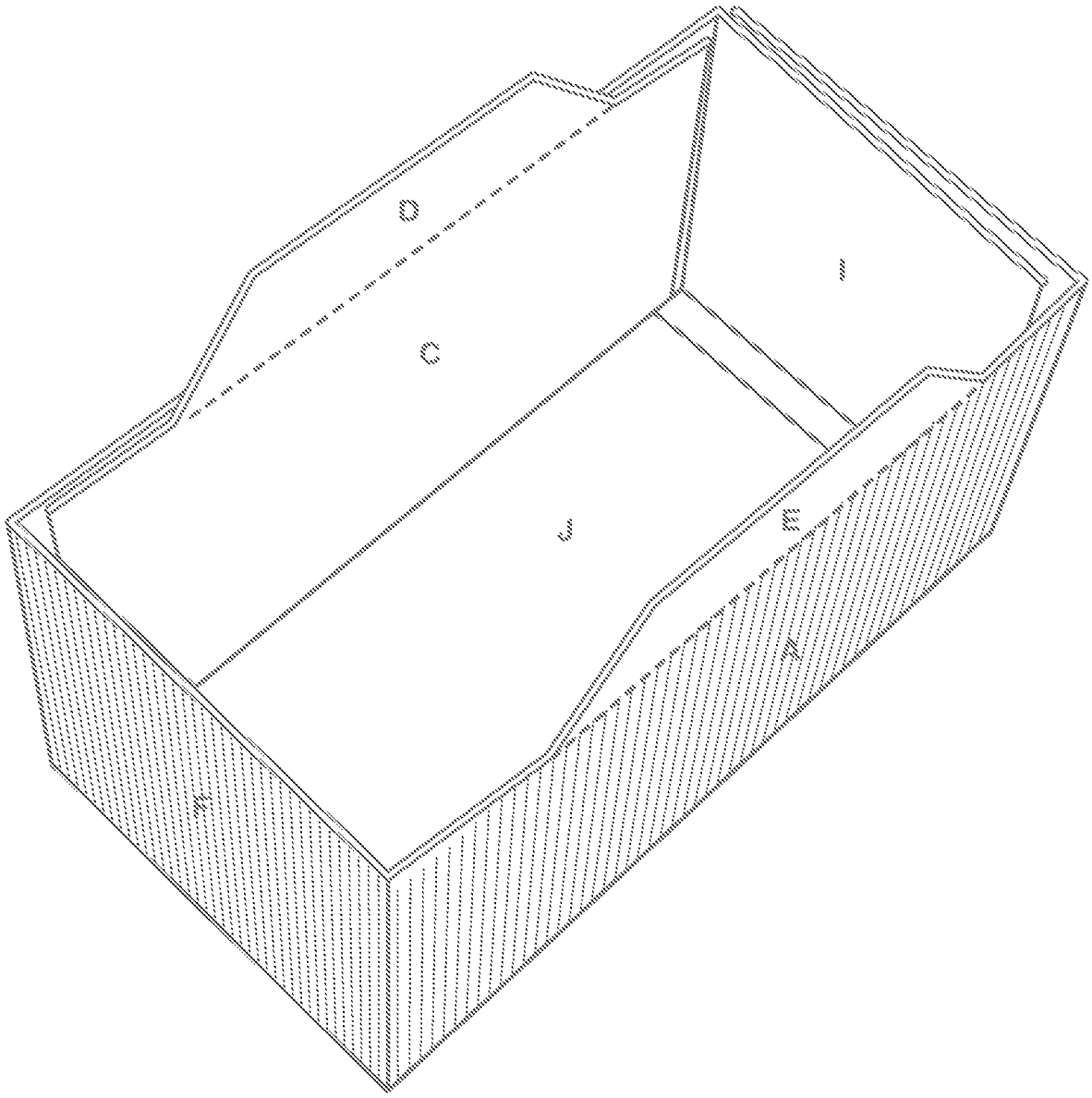

FIG. 14E shows an example in which the portions C and D have been completely tucked through the slot 170. The portions B, C, and D are referred to as a "tuck flap." The portions D and E and are folded outwards and downwards to form the locking tabs. The portion D is folded over the upper edge of the portion H.

A feature of the tray 102 is that when a downward force is applied to the bottom of the tray 102 (e.g., due to the bar 120 pressing down against the tray 102), a large portion of the force is distributed to four sides of the tray. In this example, the bottom of the tray 102 includes three layers formed by the portions B, J, and K. The portion J is connected to the portion F, so some of the downward force applied to the portion J is transferred to the portion F. The portion K is connected to the portion G so some of the downward force applied to the portion K is transferred to the portion G The portion B is connected to the portion A, so some of the downward force applied to the portion B is transferred to the portion A. The portion B is connected to the portion C, which is connected to the portion D. Because the portion D is folded over the upper edge of the portion H, some of the downward force applied to the portion B is also transferred to the portion H. Thus, a large portion of the downward force applied to the bottom of the tray 102 is transferred to the four sides (formed by the portions F, A, and H) of the tray 102.

The four sides of the tray 102 are rigid in the vertical direction of the tray (i.e., the direction parallel to the side surfaces) and can sustain a large downward force applied to the bottom of the tray 102 without deformation. The bar 120 is positioned in the tray 102, and the tray 102 is positioned within the sleeve 104, so the sidewalls of the tray 102 are sandwiched between the bar 120 and the sidewalls of the sleeve 104. This further prevents the sidewalls of the tray 102 from deforming. Thus, even when the user presses the bar 120 against a surface with a strong force (e.g., when pressing a deodorant bar against the skin), causing the bar 120 to push back against the bottom of the tray 102, the tray 102 can remain substantially rigid with minimal bending or deformation.

Figure 15A:
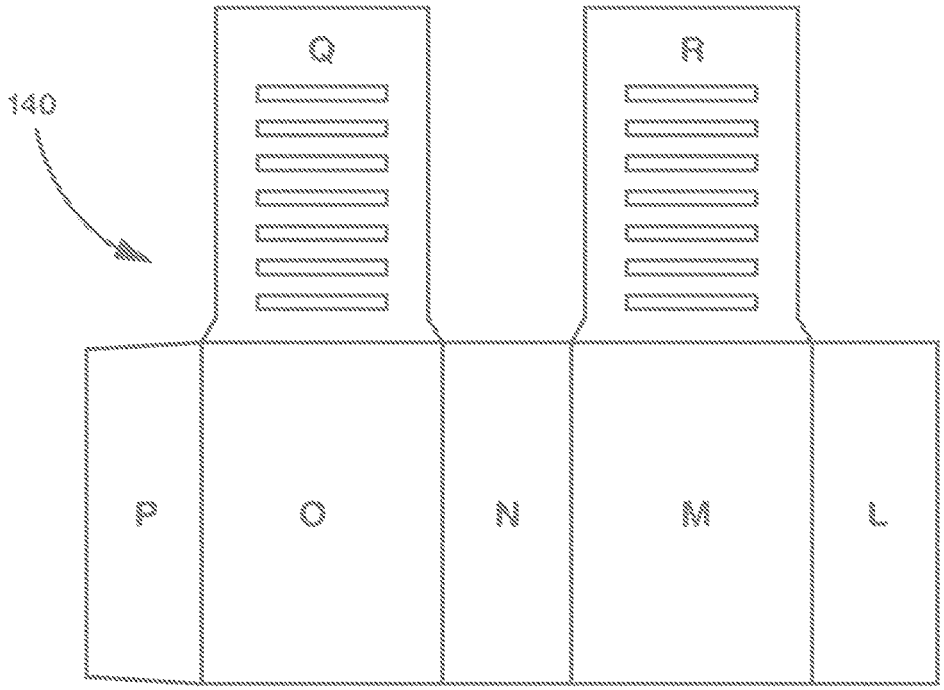
FIG. 15A is a diagram of an example of a paperboard layout for the sleeve.
Figure 15B:
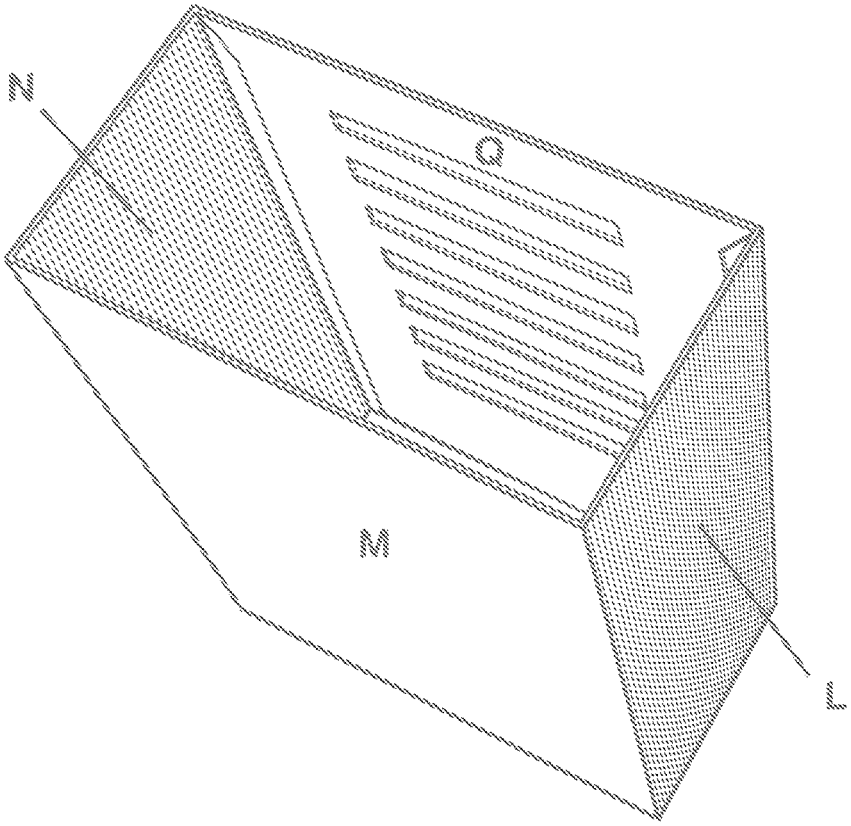
FIG. 15B is an image of an example of the sleeve formed from the paperboard.

FIG. 15A shows the layout 140 of the paperboard for the sleeve 104, in which different parts of the paperboard have been labeled from "L" to "R." FIG. 15B shows an example of the assembled sleeve 104 with the labels "L," "M," "N," and "Q" added to the corresponding portions. The portions L, M, N, and O are folded to form the sidewalls of the sleeve 104 and the portion P is glued to the portion L. The portions Q and R are folded inwards and partially glued to the portions O and M, respectively.

In some implementations, the locking mechanism on the tray and the sleeve is configured to hold the tray at predetermined positions or heights relative to the sleeve and also enable the tray to be pushed either upwards or downwards relative to the sleeve. For example, the sleeve and the tray can have embossed rounded tabs that hold the tray (and the bar held in the tray) in one of a plurality of predetermined positions, and also allow the tray (and the bar) to move upwards or downwards relative to the sleeve to another of the predetermined positions. For example, the tray can hold an air freshener bar or a fragrance bar, and the bar can be pushed back into the sleeve to limit the amount of fragrance being released.

Figure 16:
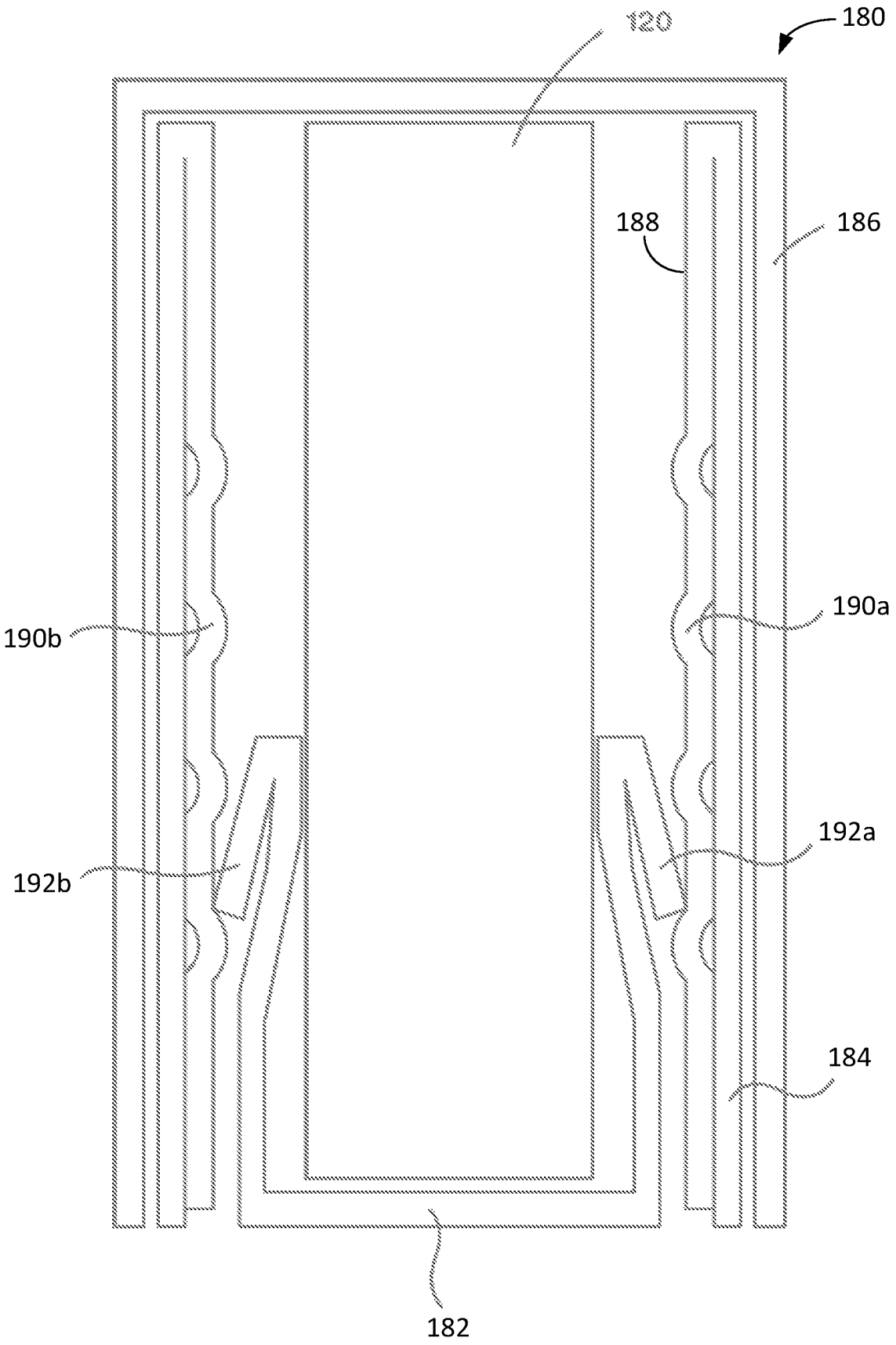
FIG. 16 is a cross-sectional diagram of an example of a carton holding a bar-shaped product.

FIG. 16 is a cross-sectional diagram of an example of a carton 180 that is configured to hold a bar-shaped product 120, such as a deodorant bar, and allow the tray (and the bar-shaped product 120) to move upwards or downwards relative to a sleeve. In some implementations, the carton 180 includes a tray 182, a sleeve 184, and a lid 186. The tray 182 and the lid 186 of FIG. 16 can be configured in a similar manner as the tray 102 and the lid 106 of FIG. 2, e.g., using the same or similar materials. The sleeve 184 has a lower opening that allows the tray 182 and the bar 120 to slide into the sleeve 184. The sleeve 184 has an upper opening that allows the bar 120 to protrude from the sleeve 184. The outer circumference of the side walls of the tray 182 is slightly smaller than the inner circumference of the side walls of the sleeve 184 so that the tray 182 can fit within the sleeve 184. The inner circumference of the side walls of the lid 186 is slightly larger than the outer circumference of the side walls of the sleeve 184 so that the lid 186 can slide over the upper part of the sleeve 184. The lid 186 covers the exposed portion of the bar 120 to keep, e.g., moisture and/or fragrance of the bar within the carton 180.

In some implementations, the inner wall or walls 188 of the sleeve 184 include embossed bumps or tabs (e.g., 190*a*, 190*b*, collectively referenced as 190) positioned at various heights along the inner walls 188. In this example, the embossed bumps 190 have curved surfaces. The tray 182 includes one or more locking tabs, e.g., 192*a* and 192*b* (collectively referenced as 192), that allow the tray 182 to be pushed either upwards or downwards within the sleeve 184 and stop at various positions defined by the embossed bumps 190. In this example, the locking tabs 192 are folded downward and allow the tray 182 to be pushed upwards and be discouraged from moving downwards within the sleeve 184. The locking tabs 192 engage the embossed bumps 190 so that the tray 182 can maintain its position at a particular height relative to the sleeve 184.

The embossed bumps 190 are configured to provide a predetermined resistance to the locking tabs 192 to enable the tray 182 to maintain its position at the particular height relative to the sleeve 184, and the resistance is selected such that it can be overcome by a downward push by the user without too much effort. The user can push the bar-shaped product 120 and the tray 182 downward, which cause the locking tabs 192 to slightly bend inwards and slide past the embossed bumps 190. This way, the user can push the bar-shaped product 120 out of the sleeve 184 to use the product 120, and retract the product 120 back into the sleeve 184 for storage.

The locking tabs 192 and the embossed bumps 190 can be configured differently to provide different amounts of resistance as the tray 182 moves upwards or downwards one step. For example, the locking tabs 192 and the embossed bumps 190 can have shapes different from the ones shown in FIG. 16. The embossed bumps 190 can be raised higher relative to the inner surface of the sleeve 184 to provide a greater resistance to the movements of the locking tabs 192. In some examples, when the carton 180 is designed to hold a product 120 that has a greater weight, the embossed bumps 190 can be configured to provide a greater resistance to the locking tabs 192 in order to support to the tray 182 and the product 120. In some examples, when the carton 180 is designed to hold a product 120 that has a smaller weight, the embossed bumps 190 can be configured to provide a smaller resistance to the locking tabs 192 to make it easier for the user to move the tray 182 relative to the sleeve 184.

In some examples, the embossed bumps 190 form a "staircase" within the sleeve 184 that allows the tray 182 to climb up or down the staircase one "stair" or embossed bump at a time. Maintaining the tray 182 at a particular height relative to the sleeve 184 allows the bar 120 to be held at a convenient and usable height.

The distance between any two consecutive embossed bumps 190 defines the step size in which the tray 182 can be maintained at particular heights relative to the sleeve 184. For example, if the embossed bumps 190 are spaced evenly apart from each other at a distance of a quarter of an inch, each time the user pushes the tray 182 upwards a step, an additional quarter of an inch of the bar 120 extends beyond the upper edge of the sleeve 184.

The locking tab 192*b* of the carton 180 can be configured in a manner similar to the locking tab 110*b* of the carton 100. In some examples, the locking tab 192*a* is connected to the adjacent sidewall of the tray 182 and is formed by folding the locking tab 192*a* along a line between the locking tab 192*a* and the adjacent sidewall, and the locking tab 192*b* is part of a tuck flap on the tray 182, similar to the configuration of the tray 102 of the carton 100. In some examples, the locking tab 192*b* is similar to the locking tab 192*a* in which the locking tab 192*b* is connected to the adjacent sidewall of the tray 182 and is formed by folding the locking tab 192*b* along a line between the locking tab 192*b* and the adjacent sidewall.

A number of embodiments of the invention have been described. Nevertheless, it will be understood that various modifications may be made without departing from the spirit and scope of the invention. Other embodiments are within the scope of the following claims. For example, in some implementations, the sleeve can have a cross section having a shape that resembles a triangle, a square, a rectangle, a rhombus, a pentagon, a polygon, a circle, or an oval, or an arbitrary shape. The carton 100 or 180 can be configured to hold an object other than a deodorant bar, such as a lip balm or a healing balm. The carton 100 or 180 can be configured to hold an object other than a personal care product, such as a fragrance bar or a bar of wax. The carton 100 or 180 is useful for holding any product that is intended to be applied to surfaces such that some material is transferred from the product to a surface each time the product is applied to the surface, so that the length of the product is reduced over time. By pushing the tray upwards relative to the sleeve, remaining portions of the product can be exposed beyond the upper edge of the sleeve.

The locking tabs 110 or 192 do not necessarily have to be formed at the upper edge of the sidewall of the tray 102. For example, a locking tab can be connected to a mid-section of a side. Each locking tab can be replaced with multiple smaller locking tabs. For example, in the example of FIG. 1, if the tab 110*a* has a length of L, the tab 110*a* can be replaced with two tabs each having a length of L/2 or slightly less than L/2. For example, instead of applying glue to securely attach portions of the paperboard together, an adhesive film can be used. The carton 100 or 180 can be made of various types of materials, including e.g., paperboards, cardboards, plastic boards, metal boards, or a combination of the above. The metal can be, e.g., tin, aluminum, or a combination or the above. The tray and/or the sleeve can be made by, e.g., paper pulp molding, injection molding, or thermoforming. The tray and/or the sleeve can include, e.g., plastic, bio-resin, paper pulp, or metal molded components.

What is claimed is:

1. A carton comprising:

a tray having at least one locking tab; and a sleeve having an inner wall having at least a first indentation and a second indentation, in which the tray and the sleeve are shaped and sized to enable the tray to move within the sleeve;

wherein the at least one locking tab is configured to engage the first indentation when the tray is at a first position relative to the sleeve to allow the tray to move beyond the first position in a first direction relative to the sleeve and provide a resistance to discourage the tray from moving in a second direction opposite the first direction relative to the sleeve;

wherein the at least one locking tab comprises a first locking tab that is positioned between a wall of the tray and the sleeve as the tray moves in the first direction away from the first position, the first locking tab has a first end attached to the wall of the tray and a second end that is movable between a third position that is closer to the wall of the tray and a fourth position that is farther away from the wall of the tray;

wherein the at least one locking tab is configured to engage the second indentation when the tray is at a second position relative to the sleeve to allow the tray to move beyond the second position in the first direction relative to the sleeve and provide a resistance to discourage the tray from moving in the second direction.

2. The carton of claim 1 in which at least one of the tray or the sleeve comprises a folded paperboard, a folded plastic sheet, or a folded metal sheet.

3. The carton of claim 2 in which at least one of the tray or the sleeve comprises at least one of plastic, bio-resin, paper pulp, or metal molded components.

4. The carton of claim 1 in which at least one of the tray or the sleeve comprises a folded paperboard, and the carton comprises a lining on the paperboard to form a moisture or oil barrier.

5. The carton of claim 4 in which the lining comprises at least one of polyresin or bioresin.

6. The carton of claim 1 in which the tray has a bottom having a first shape, the sleeve has a cross section having a second shape, and the first and second shapes are similar shapes.

7. The carton of claim 1 in which the sleeve has a cross section having a shape that resembles at least one of a triangle, a square, a rectangle, a rhombus, a pentagon, a polygon, a circle, or an oval.

8. The carton of claim 1 in which the tray is configured to hold a bar that has at least one indentation on a sidewall of the bar, and the tray comprises at least one bar locking tab configured to engage at least one of the at least one indentation on the sidewall of the bar.

9. The carton of claim 8 in which the at least one locking tab is folded outwards and downwards relative to other parts of the tray, and the at least one bar locking tab is folded inwards and downwards relative to other parts of the tray.

10. The carton of claim 8 in which the at least one locking tab comprises a first locking tab and a second locking tab that are positioned on opposite sides of the tray, and the at least one bar locking tab comprises a first bar locking tab and a second bar locking tab that are positioned on opposite sides of the tray.

11. A carton for a deodorant bar, the carton comprising:

a tray configured to hold the deodorant bar;

a sleeve, in which the tray and the sleeve are shaped and sized to enable the tray to move within the sleeve; and a locking mechanism to secure the tray at a first of a plurality of predetermined positions relative to the sleeve, in which the locking mechanism enables the tray to move beyond the first predetermined position in a first direction relative to the sleeve and prevents the tray from moving in a second direction opposite the first direction;

wherein the locking mechanism comprises a locking tab that is positioned between a wall of the tray and the sleeve as the tray moves in the first direction away from the first predetermined position, the locking tab has a first end attached to the wall of the tray and a second end that is movable between a third position that is closer to the wall of the tray and a fourth position that is farther away from the wall of the tray;

wherein the locking mechanism is configured to secure the tray at a second of the plurality of predetermined positions relative to the sleeve, in which the locking mechanism enables the tray to move beyond the second predetermined position in the first direction relative to the sleeve and prevents the tray from moving in the second direction opposite the first direction.

12. The carton of claim 11 in which at least one of the tray or sleeve comprises a folded board.

13. The carton of claim 12 in which at least one of the tray or sleeve comprises a folded paperboard or cardboard.

14. The carton of claim 13 in which the carton comprises a lining on the paperboard to form a moisture or oil barrier.

15. The carton of claim 14 in which the lining comprises at least one of polyresin or bioresin.

16. The carton of claim 11 in which the tray has a bottom having a first shape, the sleeve has a cross section having a second shape, and the first and second shapes are similar shapes.

17. The carton of claim 11 in which the sleeve has a cross section having a shape that resembles at least one of a triangle, a square, a rectangle, a rhombus, a pentagon, a polygon, a circle, or an oval.

18. The carton of claim 11 in which the locking mechanism comprises indents on inner sidewalls of the sleeve and at least one locking tab on the tray, and the at least one locking tab is configured to engage one of the indents to secure the tray at the one of the plurality of predetermined positions relative to the sleeve.

19. The carton of claim 11 in which the tray is configured to hold a bar that has at least one indentation on a sidewall of the bar, and the tray comprises at least one bar locking tab configured to engage at least one of the at least one indentation on the sidewall of the bar.

20. The carton of claim 19 in which the at least one locking tab is folded outwards and downwards relative to other parts of the tray, and the at least one bar locking tab is folded inwards and downwards relative to other parts of the tray.

21. The carton of claim 19 in which the at least one locking tab comprises a first locking tab and a second locking tab that are positioned on opposite sides of the tray, and the at least one bar locking tab comprises a first bar locking tab and a second bar locking tab that are positioned on opposite sides of the tray.

22. An apparatus comprising:

a board having a shape configured to enable the board to be folded into a tray having a tuck flap having a tab, in which the tuck flap forms a bottom wall of the tray and an inner sidewall of the tray, and the tab is folded outwards over an edge of an outer sidewall of the tray;

wherein the tuck flap comprises a first portion, a second portion, and the tab, the first portion forms the bottom wall of the tray, the second portion forms the inner sidewall of the tray, the second portion is folded inwards along a first line between the first portion and the second portion, and the tab is folded outwards along a second line between the tab and the second portion;

wherein the tab has a first surface that is on a same side as a surface of the inner sidewall prior to folding along the second line, and after the tab is folded outwards over the edge of the outer sidewall the first surface of the tab is at a first angle greater than 180° relative to the surface of the inner sidewall.

23. The apparatus of claim 22 in which the tuck flap is configured such that when a downward force pushes against the bottom wall of the tray, the tab latches on to the edge of the outer sidewall of the tray and secures the bottom wall in place.

24. An apparatus comprising:

a first board having a first shape configured to enable the first board to be folded into a sleeve having a series of indents on an inner sidewall; and a second board having a second shape configured to enable the second board to be folded into a tray having a locking tab that is configured to engage a first of the indents of the sleeve when the tray is positioned at a first position in the sleeve, wherein the locking tab is configured to engage a second of the indents of the sleeve when the tray is positioned at a second position in the sleeve;

wherein the second board is configured such that after the second board is folded into the tray and the tray is positioned in the sleeve, the locking tab is positioned between a wall of the tray and the sleeve as the tray moves away from the first position, the locking tab has a first end attached to the wall of the tray and a second end that is movable between a third position that is closer to the wall of the tray and a fourth position that is farther away from the wall of the tray.

25. The apparatus of claim 24 in which the board comprises a paperboard, a cardboard, a plastic board, or a metal board.

26. The apparatus of claim 24, in which the shape of the board is configured to enable the tray to have a tuck flap having a tab, in which the tuck flap forms a bottom wall of the tray and an inner sidewall of the tray, and the tab is folded over an edge of an outer sidewall of the tray.

27. An apparatus comprising:

a carton configured to contain a deodorant bar, the carton comprising:

a tray configured to hold the deodorant bar, the tray having at least one locking tab; and a sleeve having an inner wall having indentations, in which the tray and the sleeve are shaped and sized to enable the tray to move within the sleeve;

wherein the at least one locking tab is configured to engage a first of the indentations when the tray is at a first position relative to the sleeve to allow the tray to move beyond the first position in a first direction relative to the sleeve and provide a resistance to discourage the tray from moving in a second direction opposite the first direction relative to the sleeve;

wherein the at least one locking tab comprises a first locking tab that is positioned between a wall of the tray and the sleeve as the tray moves in the first direction away from the first position, the first locking tab has a first end attached to the wall of the tray and a second end that is movable between a third position that is closer to the wall of the tray and a fourth position that is farther away from the wall of the tray;

wherein the at least one locking tab is configured to engage a second of the indentations when the tray is at a second position relative to the sleeve to allow the tray to move beyond the second position in the first direction relative to the sleeve and provide a resistance to discourage the tray from moving in the second direction relative to the sleeve.

28. The apparatus of claim 27, further comprising the deodorant bar.

29. The carton of claim 27 in which at least one of the tray or the sleeve comprises a folded paperboard or cardboard.

30. An apparatus comprising:

a carton configured to contain a deodorant bar, the carton comprising:

a tray configured to hold the deodorant bar;

a sleeve, in which the tray and the sleeve are shaped and sized to enable the tray to move within the sleeve; and a locking mechanism to secure the tray at a first of a plurality of predetermined positions relative to the sleeve, in which the locking mechanism enables the tray to move beyond the first predetermined position in a first direction relative to the sleeve and provides a resistance to discourage the tray from moving in a second direction opposite the first direction;

wherein the locking mechanism comprises a locking tab that is positioned between a wall of the tray and the sleeve as the tray moves in the first direction away from the first predetermined position, the locking tab has a first end attached to the wall of the tray and a second end that is movable between a third position that is closer to the wall of the tray and a fourth position that is farther away from the wall of the tray;

wherein the locking mechanism is configured to secure the tray at a second of the plurality of predetermined positions relative to the sleeve, in which the locking mechanism enables the tray to move beyond the second predetermined position in the first direction relative to the sleeve and provides a resistance to discourage the tray from moving in the second direction.

31. The carton of claim 30 in which at least one of the tray or sleeve comprises a folded board.

32. The carton of claim 31 in which at least one of the tray or sleeve comprises a folded paperboard or cardboard.

33. An apparatus comprising:

a carton configured to hold a product, the carton comprising:

a tray configured to hold the product;

a sleeve, in which the tray and the sleeve are shaped and sized to enable the tray to move within the sleeve; and a locking mechanism configured to secure the tray at a first of a plurality of predetermined positions relative to the sleeve, in which the locking mechanism is configured such that when the tray is at the first of the predetermined positions, the locking mechanism provides a resistance to prevent the tray from moving away from the first predetermined position, and the locking mechanism enables the tray to be moved from the first predetermined position to a new position relative to the sleeve when a force is applied to the tray to overcome the resistance provided by the locking mechanism;

wherein the locking mechanism comprises a locking tab that is positioned between a wall of the tray and the sleeve as the tray moves away from the first of the predetermined positions, the locking tab has a first end attached to the wall of the tray and a second end that is movable between a third position that is closer to the wall of the tray and a fourth position that is farther away from the wall of the tray;

wherein the locking mechanism is configured to secure the tray at a second of the plurality of predetermined positions relative to the sleeve, in which the locking mechanism is configured such that when the tray is at the second of the predetermined positions, the locking mechanism provides a resistance to prevent the tray from moving away from the second predetermined position, and the locking mechanism enables the tray to be moved from the second predetermined position to a new position relative to the sleeve when a force is applied to the tray to overcome the resistance provided by the locking mechanism.

34. The apparatus of claim 33 in which the locking mechanism enables the tray to move in a first direction relative to the sleeve and prevents the tray from moving in a second direction opposite the first direction.

35. The apparatus of claim 34 in which the sleeve comprises a plurality of indents formed on an inner sidewall of the sleeve, and the tray includes at least one locking tab configured to engage at least one of the indents on the sleeve.

36. The carton of claim 1 wherein the inner wall of the sleeve has at least the first indentation, the second indentation, and a third indentation, wherein the at least one locking tab is configured to engage the third indentation when the tray is at a third position relative to the sleeve to allow the tray to move beyond the third position in the first direction relative to the sleeve and provide a resistance to discourage the tray from moving in the second direction.

37. The carton of claim 36 wherein the inner wall of the sleeve has at least the first indentation, the second indentation, the third indentation, and a fourth indentation, wherein the at least one locking tab is configured to engage the fourth indentation when the tray is at a fourth position relative to the sleeve to allow the tray to move beyond the fourth position in the first direction relative to the sleeve and provide a resistance to discourage the tray from moving in the second direction.

38. The carton of claim 37 wherein the inner wall of the sleeve has at least the first indentation, the second indentation, the third indentation, the fourth indentation, and a fifth indentation, wherein the at least one locking tab is configured to engage the fifth indentation when the tray is at a fifth position relative to the sleeve to allow the tray to move beyond the fifth position in the first direction relative to the sleeve and provide a resistance to discourage the tray from moving in the second direction.

39. The carton of claim 1, wherein the tray comprises a first set of walls that define a first opening that faces towards a first direction;

the sleeve comprising a second set of walls that define a second opening that also faces towards the first direction; and wherein each wall in the first set of walls is parallel to a corresponding wall in the second set of walls.

40. The carton of claim 1, wherein the second end of the first locking tab is configured to engage the first indentation when the tray is at a first position relative to the sleeve, the first locking tab is configured such that when the tray is pushed from the first position in the first direction, the first locking tab is configured to move closer to the first wall to allow the first locking tab to be positioned between the first wall and the sleeve as the tray moves in the first direction.

41. A carton comprising:

a tray having at least one locking tab, wherein the tray comprises a first set of walls that define a first opening that faces towards a first direction; and a sleeve comprising a second set of walls that define a second opening that also faces towards the first direction, wherein the sleeve has an inner wall having at least a first indentation and a second indentation, the tray and the sleeve are shaped and sized to enable the tray to move within the sleeve, wherein the sleeve, each of the first set of walls is parallel to a corresponding wall in the second set of walls;

wherein the at least one locking tab is configured to engage the first indentation when the tray is at a first position relative to the sleeve to allow the tray to move beyond the first position in a first direction relative to the sleeve and provide a resistance to discourage the tray from moving in a second direction opposite the first direction relative to the sleeve; and wherein the at least one locking tab is configured to engage the second indentation when the tray is at a second position relative to the sleeve to allow the tray to move beyond the second position in the first direction relative to the sleeve and provide a resistance to discourage the tray from moving in the second direction.

42. The apparatus of claim 22 wherein the first portion of the tuck flap has a first edge that is connected to a second sidewall and a second edge that is connected to the second portion; and wherein the first portion of the tuck flap has a third edge and a fourth edge that are not connected to any other part of the board.

* * * * *